United States Patent [19]

Nakamura et al.

[11] Patent Number: 5,066,570

[45] Date of Patent: Nov. 19, 1991

[54] WET PROCESSING OF SILVER HALIDE PHOTOSENSITIVE MATERIAL

[75] Inventors: Takashi Nakamura, Minami; Toshio Kurokawa, Odawara, both of Japan

[73] Assignee: Fuji Photo Film Co., Ltd., Kanagawa, Japan

[21] Appl. No.: 600,933

[22] Filed: Oct. 22, 1990

Related U.S. Application Data

[60] Continuation-in-part of Ser. No. 592,413, Oct. 2, 1990, which is a division of Ser. No. 499,746, Mar. 27, 1990, Pat. No. 4,980,714.

[30] Foreign Application Priority Data

Apr. 19, 1989 [JP] Japan ..... 1-99855

[51] Int. Cl.[5] ..... G03C 5/39

[52] U.S. Cl. ..... 430/421; 430/372; 430/393; 430/400; 430/428; 430/430; 430/431; 430/455; 430/460; 430/461; 354/322

[58] Field of Search ..... 430/372, 393, 400, 421, 430/428, 430, 431, 455, 460, 461; 354/322

[56] References Cited

U.S. PATENT DOCUMENTS 4,719,173 1/1988 Hahm ..... 430/400
4,780,737 10/1988 Kobayashi et al. ..... 354/322
4,980,714 12/1990 Nakamura et al. ..... 354/322

*Primary Examiner*—Hoa Van Le
*Attorney, Agent, or Firm*—Sughrue, Mion, Zinn Macpeak & Seas

[57] ABSTRACT

A processing tank is partitioned into a plurality of compartments which are serially connected to define a continuous processing path having an entrance and an exit for photosensitive material. The path is filled with a processing solution having a desilvering function such that the processing solution in at least one compartment has a different composition from the processing solution in at least one of the remaining compartments. Silver halide photosensitive material is successively passed through the compartments without contact with the ambient air. Desilvering the photosensitive material after exposure and development in this way reduces the amount of processing solution used, especially replenished, while achieving improved photographic properties.

17 Claims, 10 Drawing Sheets

WET PROCESSING OF SILVER HALIDE PHOTOSENSITIVE MATERIAL

This application is a continuation-in-part application of a divisional application Ser. No. 592,413 filed Oct. 2, 1990, from copending application Ser. No. 499,746 filed Mar. 27, 1990 U.S. Pat. No. 4,980,714.

CROSS-REFERENCE TO THE RELATED APPLICATION

This application is related to copending application Ser. No. 340,820 filed Apr. 20, 1989 pending, for "Method and Apparatus for Processing Photosensitive Material" by Nakamura and Kurokawa, which is incorporated herein by reference.

FIELD OF THE INVENTION

This invention relates to a method for desilvering silver halide photosensitive material.

BACKGROUND OF THE INVENTION

In general, the wet processing of an exposed silver halide photosensitive material (to be simply referred to as a photosensitive material, hereinafter) includes a series of steps, typically development, bleach-fixation, and water rinsing for obtaining color images.

Among these steps, the bleaching step is an essential step for producing color images while bleach-fixation is performed either separately as bleaching and fixing steps or simultaneously as a single blix step depending on the type of photosensitive material.

Only a fixing step is required in producing black-and-white images.

Both the bleaching and fixing steps belong to a desilvering step intended for removing unnecessary silver images.

Like other processing solutions, the processing solutions having a desilvering function used in these processing steps, for example, bleaching, blix, and fixer solutions undergo exhaustion or deterioration with the progress of photosensitive material processing and with the lapse of time. One common approach is a system adapted to make up replenisher solution during processing for maintaining the function of the processing solution constant.

In accordance with the recent general demands, environmental maintenance and resource saving are also imposed on the processing of photosensitive materials. It is desirable from an environmental point of view to reduce the amount of processing solutions having a desilvering function such as bleaching, blix and fixer solutions used, especially replenished in the desilvering steps.

Since the desilvering step cannot fully exert its function by processing in a single blix bath, it usually uses two or more baths of bleaching-fixation, bleaching blix, bleaching-blix-fixation and so on, which requires a larger size of apparatus, giving rise to a problem in addition to the increased replenishment.

The blix solution has a problem in processing a minimal quantity of photosensitive material that a bleaching agent in the solution can oxidize a commonly used thiosulfate fixing agent to form sulfides in the processing tank or associated replenishing tank, eventually causing a replenishing pump or circulating pump to be clogged therewith.

In turn, in processing a large quantity of photo sensitive material, the blix solution has other problems of deficient color recovery and poor photographic quality.

SUMMARY OF THE INVENTION

Therefore, a primary object of the present invention is to provide a method for wet processing photosensitive material which can reduce the amount of a processing solution having a desilvering function used, especially replenished, allows the use of a smaller size of apparatus, and can produce images of high photographic quality.

According to the present invention, there is provided a method for wet processing a silver halide photosensitive material after development by desilvering the photosensitive material with a processing solution having a desilvering function in a processing tank. A plurality of compartments are partitioned in the processing tank and serially connected to define a continuous processing path having an entrance and an exit for the photosensitive material. The path is filled with the processing solution such that the processing solution in at least one compartment has a different composition from the processing solution in at least one of the remaining compartments. The photosensitive material is successively passed through the compartments of the path without contact with the ambient air.

Preferably, said at least one compartment is filled with a processing solution selected from the group consisting of a processing solution having a substantial bleaching function, a processing solution having a substantial fixing function, and a processing solution having substantial bleaching and fixing functions, and said at least one of the remaining compartments is filled with a processing solution selected from said group, but different from the selected solution in said at least one compartment.

Preferably, said continuous processing path includes at least two regions filled with different processing solutions selected from said group.

Preferably, said continuous processing path includes a plurality of inlets for respectively replenishing a corresponding plurality of processing solutions having different compositions at different locations.

Preferably, said continuous processing path includes a plurality of inlets for respectively replenishing a corresponding plurality of processing solutions having different functions at different locations, the processing solutions being selected from the group consisting of a processing solution having a substantial bleaching function, a processing solution having a substantial fixing function, and a processing solution having substantial bleaching and fixing functions.

Preferably, said continuous processing path includes a first region filled with a processing solution having a substantial bleaching function and a second region disposed on the exit side of the first region for the photosensitive material and filled with a processing solution having substantial bleaching and fixing functions.

Preferably, the method further includes the steps of: providing a first inlet on the entrance side of said first region for the photosensitive material, replenishing the processing solution having a substantial bleaching function into said first region through the first inlet, providing a second inlet on the entrance side of said second region for the photosensitive material, and replenishing the processing solution having a substantial fixing function into said second region through the second inlet.

Preferably, an outlet is disposed on the exit side of said second region for the photosensitive material for discharging the solution.

Preferably, said continuous processing path includes a first region filled with a processing solution having a substantial bleaching function, a second region disposed on the exit side of the first region for the photosensitive material and filled with a processing solution having substantial bleaching and fixing functions, and a third region disposed on the exit side of the second region for the photosensitive material and filled with a processing solution having a substantial fixing function.

Preferably, the method further includes the steps of providing a first inlet on the entrance side of said first region for the photosensitive material, replenishing the processing solution having a substantial bleaching function into said first region through the first inlet, providing a second inlet on the exit side of said third region for the photosensitive material, and replenishing the processing solution having a substantial fixing function into said third region through the second inlet.

Preferably, the method further includes the steps of providing a third inlet on the entrance side of said second region for the photosensitive material, and replenishing the processing solution having a substantial fixing function into said second region through the third inlet.

Preferably, an outlet is disposed in said second region for discharging the solution.

Preferably, said continuous processing path includes a channel for providing flow communication between the compartments.

Preferably, at least three processing compartments are partitioned in the tank.

Preferably, the tank further includes partitions for partitioning the compartments such that little flow of processing solution occurs between the compartments when no photosensitive material is passed.

Preferably, said continuous processing path further includes a region disposed on the exit side of said second or third region for the photosensitive material and filled with a processing solution having a washing and/or stabilizing function.

In the practice of the present invention, a silver halide photosensitive material after exposure is subjected to development, bleach-fixation as desilvering, washing and other steps in accordance with the given processing order.

In the bleach-fixation step, a processing solution having a desilvering function is received in at least two of a plurality of compartments partitioned in the processing tank so as to enable processing in at least two baths. As opposed to the prior art multi-stage desilvering technique using two or more baths, the silver halide photosensitive material is desilvered in the respective compartments without contact with air.

In the embodiment wherein the continuous processing path includes at least two regions for at least two of bleaching, fixation and bleach-fixation functions such that each region includes a plurality of compartments, a concentration gradient of processing solution occurs between the compartments, resulting in improved processing efficiency. Then the amount of processing solution used, especially replenished can be reduced. A smaller size of apparatus may be used.

In addition, there are produced images of high photographic quality.

In the embodiment wherein a processing solution having a bleaching function is supplied into the continuous processing path from the entrance side, a processing solution having a fixing function supplied into the path from the exit side, and an outlet disposed at an intermediate for discharging the solution, the processing solution having a bleaching function is replenished such that the solution in the respective compartments has the concentration of bleaching agent reduced stepwise from the entrance side and the solution flows in the same direction as the travelling direction of the photosensitive material. In turn, the processing solution having a fixing function is replenished such that the solution in the respective compartments has the concentration of fixing agent reduced stepwise from the exit side and the solution flows in the opposite direction to the travelling direction of the photo-sensitive material. The solutions join together at an intermediate of the continuous processing path to provide a blix composition.

This leads to processing in the order of bleaching→bleach-fixing→fixing with increased desilvering efficiency. The amount of processing solutions having bleaching and fixing functions replenished can be reduced, resulting in a reduction in the amount of exhausted solution to be discarded. In addition, there are produced images of high photographic quality.

Since a processing solution having a bleaching function (or bleaching solution) is supplied from the entrance side for photosensitive material, the material after color development is first bleached with the bleaching solution at lower pH, preventing the occurrence of bleaching fog. Poor color recovery will scarcely occur because the material is initially bleached with the bleaching solution having high activity.

A processing solution having a fixing function (or fixer) is supplied from the exit side for photosensitive material, while the concentration of bleaching agent in the bleaching solution which causes excess coloring and adversely affects color image fading gradually lowers so that the bleaching agent is substantially eliminated from the photosensitive material at the final exit thereof. Consequently, undesirable coloring is minimized and color image shelf life is improved even with mild washing, brief washing, or washing with less replenishment.

In the practice of the invention, the desilvering step may be followed by a washing and/or stabilizing step within the continuous processing path. Then a further size reduction of the processor is expected and the processing time is shortened.

DESCRIPTION OF THE PREFERRED EMBODIMENTS

The present invention will be described in detail.

Figure 1:
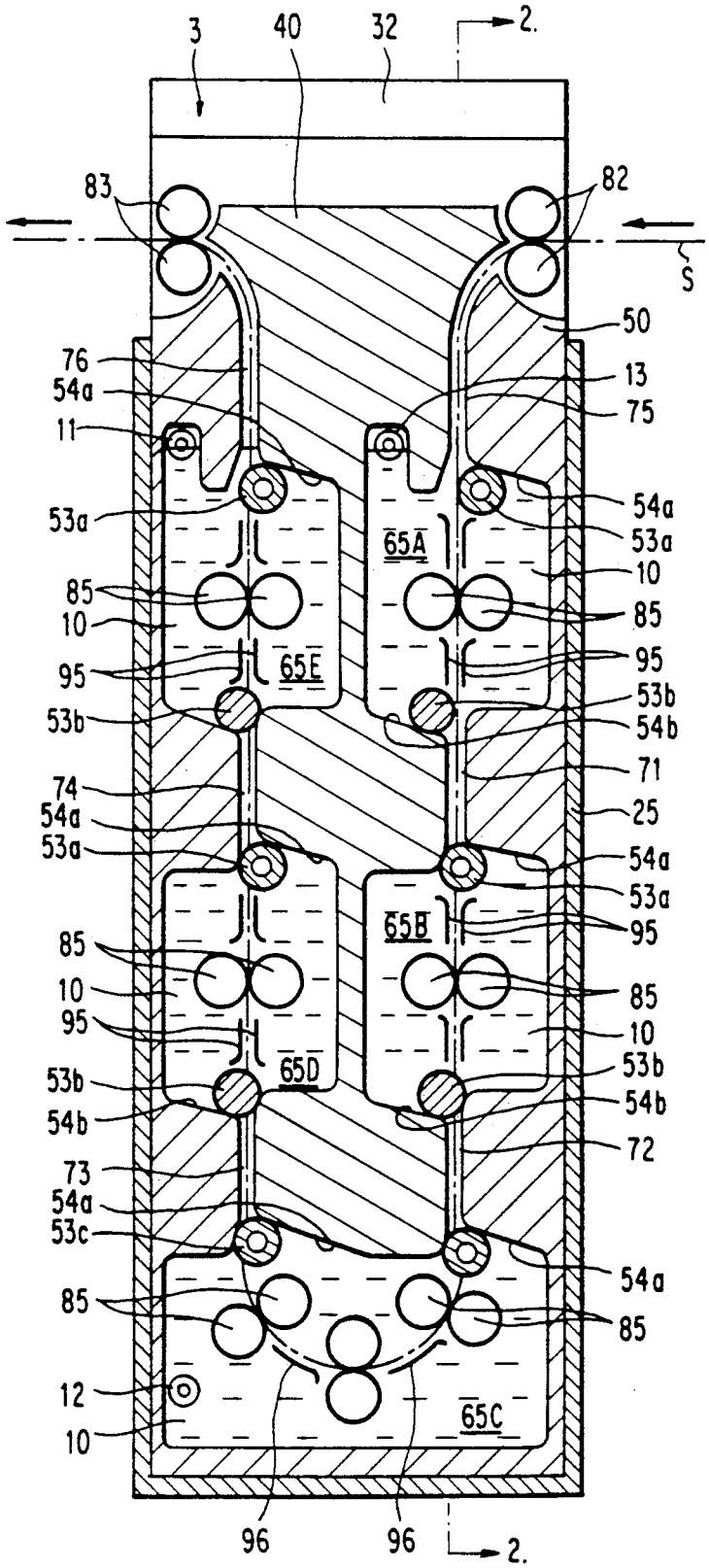
FIG. 1 is an elevational cross section of a processing tank used in the present invention.
Figure 2:
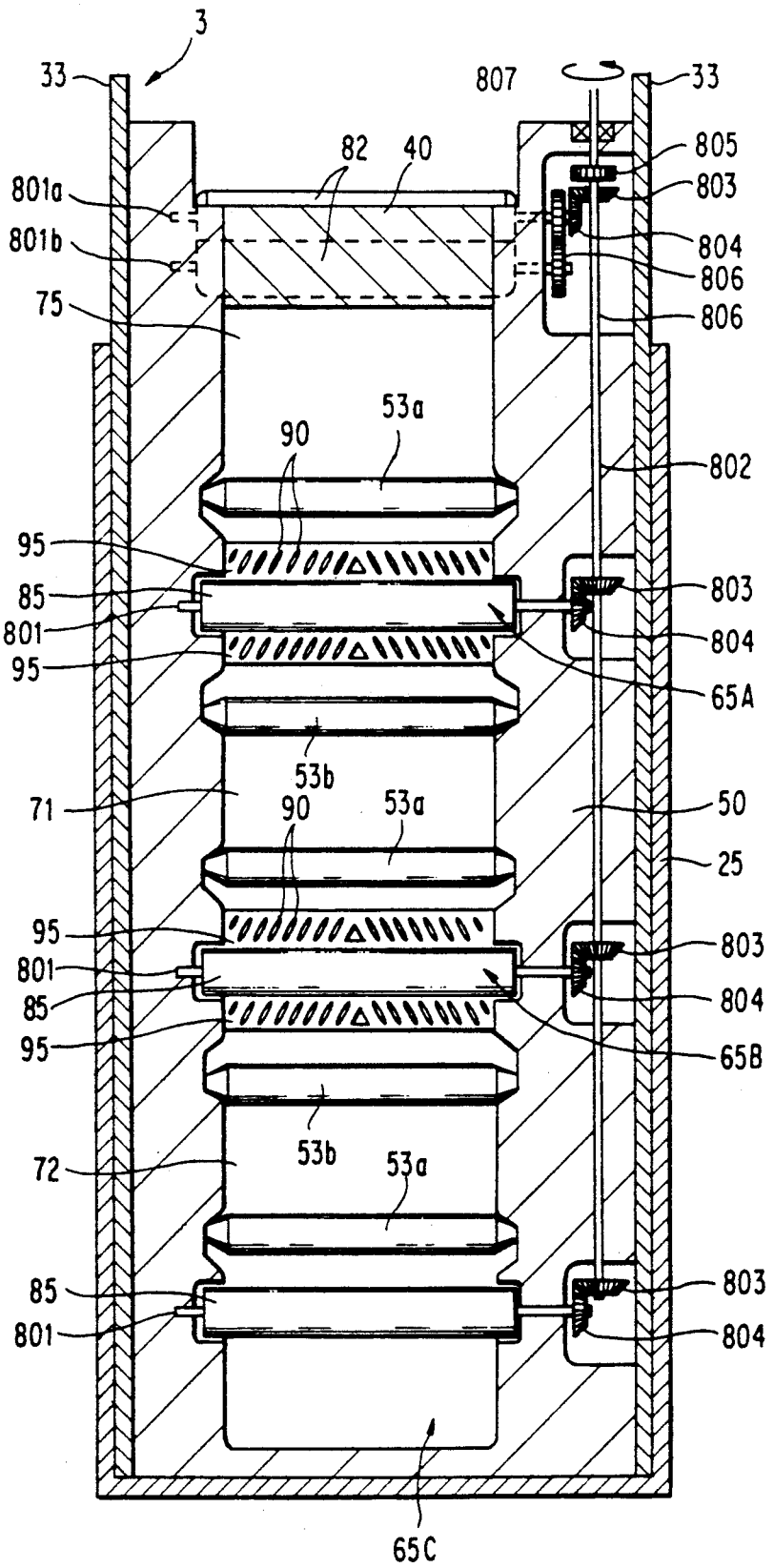
FIG. 2 is a cross section taken along lines II—II in FIG. 1.

FIGS. 1 and 2 illustrate a processing apparatus or tank having a processing solution having a desilvering function received therein which is useful in the practice of the method for processing silver halide photosensitive material according to the present invention.

The processing tank shown in FIGS. 1 and 2 includes a plurality of processing compartments 65A to 65E which are successively connected through narrow channels 71 to 74. The compartments 65A to 65E are filled with a processing solution 10 such that the solution may vary its composition from compartment to compartment while a silver halide photo-sensitive material (to be referred to as a photosensitive material, hereinafter) S is successively passed therethrough for desilvering.

The use of a processing tank of such construction can reduce the amount of processing solution used and increase the efficiency of desilvering process.

The processing tank shown in FIGS. 1 and 2 has a rack assembly 3 accommodated therein. The rack assembly 3 includes blocks 40 and 50 mounted between side plates 32 and 33.

The block 40 is disposed inside the block 50. With the blocks 40 and 50 mated, five processing compartments 65A, 65B, 65C, 65D and 65E are defined therebetween as spaces for desilvering photosensitive material S. Narrow channels 71, 72, 73 and 74 are defined between two adjoining compartments 65A and 65B, 65B and 65C, 65C and 65D, and 65D and 65E for fluid communication therebetween. Further similar narrow channels 75 and 76 are defined above the compartments 65A and 65E for carrying the photosensitive sheet S into and out of the tank or processing solution.

The blocks 40 and 50 are solid members in the illustrated embodiment, but not limited thereto. They may be hollow members and molded from resins or the like.

In this embodiment, each compartment may have a volume of 1 to 8,000 ml, preferably 3 to 4,000 ml, more preferably 10 to 800 ml. Within this range of volume, the amount of processing solution and its replenisher can be reduced and processing efficiency is improved.

The gap distance in cross section of the channels 71 to 76 may be about 0.5 to about 5 mm. The channels of such a gap allow the photosensitive material S to travel therethrough without any disturbance.

For facilitated passage, the channels 71 to 76 on the opposed surfaces may be treated to be water repellent.

Disposed approximately at the center in each of the processing compartments 65A, 65B, 65D, and 65E are a pair of feed rollers 85. Three pairs of feed rollers 85 are disposed in the processing compartment 65C. Disposed in proximity to the entrance of the channel 75 are loading rollers 82 for carrying the photosensitive material S into the processing solution 10. Disposed in proximity to the exit of the channel 76 are unloading rollers 83 for carrying the photosensitive material S out of the tank.

The loading rollers 82, unloading rollers 83, and feed rollers 85 are pivotally supported to the block 40 or 50 such that either or both of the rollers are driven for rotation to carry the photosensitive material 100 forward while clamping it therebetween.

The drive mechanism for the rollers 85 is illustrated in FIG. 2 as including a vertical drive shaft 802 received in the block for rotation and bevel gears 803 fixedly secured to the shaft 82 at predetermined positions. Each of the feed rollers 85 includes a rotating shaft 801 having a bevel gear 804 fixedly secured to one end thereof in mesh with the bevel gear 803 on the drive shaft 802. Then, each feed roller 85 can be rotated by rotating the drive shaft 802 in a predetermined direction by means of a suitable drive such as a motor (not shown).

One loading roller 82 has a rotating shaft 801*a* offset from the drive shaft 802. A driven shaft 806 is supported parallel to the drive shaft 802 and coupled to the drive shaft 802 through a gear train including a gear 805 fixedly secured to the drive shaft 802. A bevel gear 803 fixedly secured to the driven shaft 806 is in mesh with another bevel gear 804 fixedly secured to the shaft 801*a* of one roller at one end thereof for rotating the shaft 801*a*. The roller shaft 801*a* also has a gear 807 secured thereto inside the bevel gear 804, which is in mesh with a gear 808 secured to the shaft 801*b* of the other roller 82 at one end thereof. Then both the rollers 82 are simultaneously rotated.

For each pair of feed rollers 85 in the processing compartment, one roller is driven for rotation and the other roller is rotated therewith due to frictional engagement between their peripheral surfaces. It is possible to couple the rollers of each pair through gears so that both the rollers are driven for rotation.

The rollers may preferably be formed of a material which is durable and undergoes no deformation, expansion or weakening under the action of processing solution, like the foregoing rollers.

Disposed above and below the feed rollers 85 in each of the compartments 65A, 65B, 65D and 65E are two pairs of guide plates 95 for guiding the photosensitive sheet S. Disposed between the feed rollers 85 in the compartment 65C are reverse guides 96 in the form of an arcuate plate for assisting in reversing the travel direction of the photo-sensitive sheet S.

These guide members 95 and 96 may be cf sheet metal or molded plastic material. Often the guide members are formed with perforations 90 distributed approximately uniformly thereon.

The perforations 90 in the guide members 95 and 96 allow passage of processing solution 10 therethrough, resulting in promoted circulation of processing solution and increased processing efficiency.

Disposed at the transitions between the processing compartments 65A to 65E and the channels 71 to 76 are shutter or partition means for shutting or closing the transitions when no photosensitive material S travels in the form of valves 53*a* and 53*b*. Both the valves 53*a* and 53*b* are in the form of a cylinder or roller having tapered or frustoconical portions at axially opposed ends as shown in FIG. 2, but they are somewhat different in detail.

The valve 53*a* has a lower specific gravity than the processing solution 10 such that the valve may float up due to buoyancy for blocking the upper opening of each compartment 65A–65E.

In contrast, the valve 53*b* has a higher specific gravity than the processing solution such that the valve may sink to the bottom for blocking the lower opening of each of the compartments 65A, 65B, 65D and 65E.

The specific gravity of valves 53*a* and 53*b* may be determined by a choice of proper material. When the valves 53*a* and 53*b* are solid cylinders, the valves 53*a* may be formed of a foamed plastic material such as foamed polypropylene, foamed polyphenylene oxide (PPO), and foamed acrylonitrile-butadiene-styrene (ABS), and the valves 53*b* may be formed of a rigid plastic material such as rigid polyvinyl chloride, ABS resin and PPO.

It is also possible to form the valves 53*a* from a material having a higher specific gravity than the processing solution 10 by molding a hollow cylinder having buoyancy as shown in FIG. 1.

As to the valves 53*b*, their overall specific gravity may be increased, if desired, for example, by inserting a core of metal or other heavy material (not shown).

From the point of view of providing ar improved seal against the channels 71 to 76, it is preferred to form the valve cylinders 53*a* and 53*b* from an elastomeric material such as silicone rubber and various other elastomers or to cover the rolling periphery of the valves 53*a* and 53*b* with such elastomeric material.

These valves 53*a* and 53*b* block the access openings of the compartments to the channels 71 to 76 when no photo-sensitive material S travels, but allow passage of photo-sensitive material S when they are moved aside by the incoming photosensitive material S to tumble along inclined surfaces 54*a* and 54*b* of blocks 40 and 50.

After the photosensitive material S has passed, the valves 53*a* and 53*b* resume their original position to block the access openings of the compartments to the channels 71 to 76 again.

The shutter means associated with the compartments 65A to 65E is not limited to the illustrated embodiment, but may have any desired design.

Figure 8:
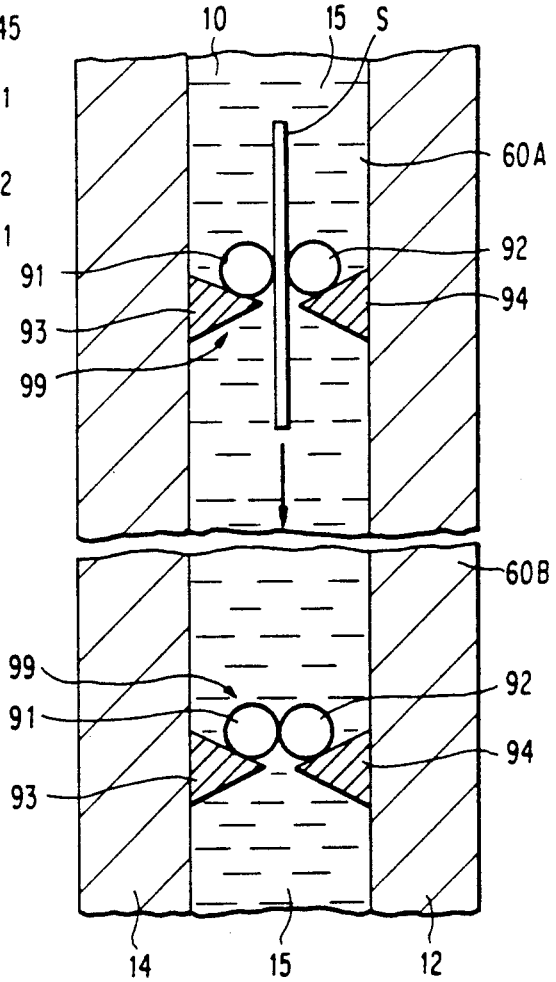

For example, partitioning members 141 in the form of a pair of blades as shown in FIG. 8 may be effectively provided as channels 71, 72, 73 and 74.

The processing tank having compartments defined therein as mentioned above can improve the efficiency of desilvering process and reduce the quantities of processing solution used and replenished because little communication occurs between processing solutions in the compartments during quiescent periods and only slow communication occurs there-between during processing of photosensitive material S, particularly when the shutter means or partition member is incorporated, while little contact occurs between photo-sensitive material S and air during desilvering process.

The term "little communication" means that the flow of the processing solution is substantially negligible, the flow of the processing solution being preferably at most 30 ml/min., more preferably at most 10 ml/min., most preferably at most 2 ml/min.

The term "slow communication" means that the flow of the processing solution (preferably in the same direction as the travel direction of the photosensitive material) occurs slowly, the flow of the processing solution being preferably 0.1 to 100 ml/min., more preferably 0.3 to 30 ml/min., most preferably 1 to 20 ml/min.

With the apparatus in which the compartments 65A to 65E of the processing tank are filled with a single processing solution, as its replenisher is made up with the progress of processing of photosensitive material, the processing solutions in the compartments vary their composition and there occurs a gradient in the concentration of every compound in the processing solution or dissolved out of the photosensitive material.

Once a concentration gradient is established, it is maintained by restricting the flow communication between the compartments as mentioned above, resulting in improved processing efficiency.

According to the invention, the processing solution in at least one compartment is intentionally varied in composition from the processing solution in at least one of the remaining compartments.

More particularly, provision is made such that at least one agent in the desilvering processing solution composition, especially at least one of bleaching and fixing agents is present in at least one compartment, but substantially absent in at least one of the remaining compartments.

To maintain such a change of composition, replenishers of different compositions are made up at different locations and a discharge port is placed at an intended location.

For example, in one embodiment where a bleaching solution is fed and replenished into compartment 65A through an inlet port 13 and a bleach-fixing solution fed and replenished into compartment 65C through an inlet port 12, the concentration of the ingredients of the bleaching solution become high in compartment 65A, the concentration of the ingredients of the fixing solution become high in compartment 65C, all these concentrations become low in the final compartment 65E where a discharge port 11 is placed, and these concentration gradients are somewhat maintained. In this embodiment, the compartments 65A and 65B form a first region of the bleaching solution composition and the compartments 65C, 65D and 65E form a second region of the bleach-fixing solution composition wherein their ingredients vary in the respective compartments.

Maintenance of such a graded concentration is effective particularly with the bleaching agent in the bleaching or bleach-fixing solution.

The bleaching agent having oxidizing power raises a problem in processing a minimal quantity of photosensitive material that the bleaching agent will oxidize a thiosulfate fixing agent to form sulfides in the processing tank or associated replenishing tank, eventually causing a replenishing pump or circulating pump to be clogged therewith. The present invention adapted to maintain a graded concentration and a high bleaching power allows the content of bleaching agent to be reduced, eliminating the problem.

In turn, in processing an extremely large quantity of photosensitive material, the use of an iron chelate compound as a bleaching agent, for example, has the problem of frequent occurrence of poor color recovery because an iron (II) compound is formed more as a result of its reduction. Maintenance of a graded concentration as mentioned above ensures that a sufficient amount of bleaching agent be available at the start of bleaching and thus allows the content of bleaching agent to be reduced as a whole, also eliminating the problem.

Although a prior art technique of reducing the content of bleaching agent to overcome the above-mentioned problem failed to provide satisfactory photographic properties, the present invention maintains a graded concentration so as to provide a higher proportion of iron (III) component at the early stage of bleaching and is thus successful in providing satisfactory photographic properties.

Similar benefits are obtained for another component by selecting a compartment(s) therefor.

In the foregoing embodiments, processing is done while making up replenishers for the respective processing solutions from the selected compartments. This enables processing with fresh processing solution at a predetermined, preferred stage of desilvering process and maintains a graded concentration, providing better results.

The compartments to which the respective processing solutions are supplied may be determined in accordance with a particular processing procedure.

In this supply system, a processing solution containing only a particular component may be supplied at a preferred stage of desilvering process.

In the foregoing embodiments, a component (or agent) in each processing solution forms a graded concentration in the compartments. In a typical example in which a single processing solution and its replenisher is supplied through only a selected compartment, a higher processing efficiency is expected by designing such that the concentration in the selected compartment is about 1.5 to 10 times the concentration in the final compartment and the concentrations in the respective compartments increase toward the selected compartment in an approximately geometric series manner.

In the embodiment wherein the bleaching and fixing solutions are respectively supplied to the first and third compartments as previously mentioned, the concentration of bleaching agent in the third compartment is about 1.2 to 2 times the concentration in the fourth compartment.

By maintaining such a graded concentration, the content of a certain agent, for example, bleaching agent in the processing solution can be reduced. This saving will sometimes result in improved photographic properties.

An increase in processing efficiency of desilvering process is also attributable to the maintenance of a graded concentration of an agent in each compartment entrained from the preceding tank.

More particularly, an agent which is carried by the photosensitive material S from the preceding tank into the relevant tank is at the highest concentration in compartment 65A and lowers its concentration toward compartment 65E through which the agent is discharged, so that a graded concentration is maintained.

For example, attention is now paid to an iron (III) chelate compound of a bleaching agent, though it is not a carry-in component, as an index indicating the differential concentration of an agent to be carried in from the preceding tank. The concentration of iron (III) chelate compound in the first compartment is $10^1$ to $10^3$ times the concentration in the final compartment.

An inlet port 13 for supplying a processing solution and its replenisher and an outlet port 11 for discharging the solution while maintaining the solution surface at a desired level are provided in the compartments 65A and 65E near the solution surface, respectively.

In addition, the selected compartments are provided with inlet ports 12 and 13 for supplying selected processing solutions and their replenishers therein.

Besides, replenishing tanks (not shown) or the like are provided.

Accordingly, with the above-mentioned arrangement, the photosensitive material S, after developed or otherwise processed according to its processing procedure, is carried into the processing solution 10 by the loading rollers 82, successively passed through compartments 65A to 65E for processing, and finally taken out by the unloading rollers 83.

Prior to actual processing, the respective compartments are filled with selected processing solutions.

More particularly, a bleaching solution is supplied into compartment 65A through inlet port 13 and thereafter, a fixing solution supplied into compartment 65C through inlet port 12.

Then, a gradient in the concentration of a processing solution component is established among compartments 65A to 65E.

During processing, a bleaching replenisher is supplied into compartment 65A through inlet port 13 and a fixing replenisher supplied into compartment 65C through inlet port 12. The overflow is discharged from compartment 65E through outlet port 11.

In this embodiment, the replenishers flow in the same direction as the travel direction of photosensitive material S, that is, parallel flow.

The parallel flow can further increase the efficiency of desilvering process. The flow rate of parallel flow is as previously described.

Exchange with more fresh solution becomes possible while maintaining the graded concentration of the processing solutions in the compartments 65A to 65E.

In the processing tank shown in FIGS. 1 and 2, the processing solution 10 preferably passes through the compartments in a parallel flow manner as just mentioned.

In addition, it is also preferred to place means for forming a liquid flow in the form of rectifying plates in each compartment so that the processing solution 10 in each compartment may flow parallel to the film surface of photo-sensitive material S and perpendicular to the travel direction of photosensitive material S.

The efficiency of desilvering process can be increased by forming a forced flow of solution, although the quantity of solution flow between the compartments is reduced and a differential concentration is maintained between the compartments.

Such a forced flow may be formed in one or some of the compartments.

The solution flow is at a flow rate of about 20 to 20,000 ml/min.

Figure 3:
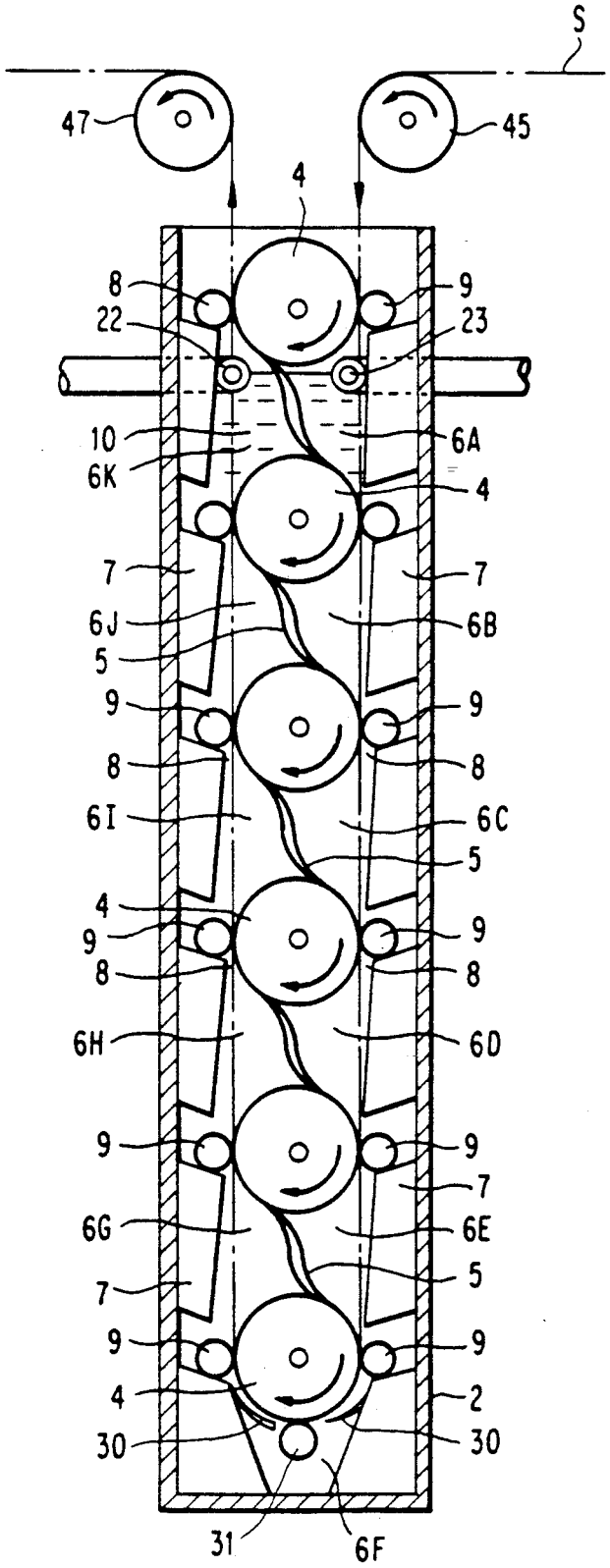
FIG. 3 is an elevational cross section of another embodiment of the processing tank used in the present invention.

The processing tank having a plurality of compartments partitioned therein according to the present invention may be embodied by the configuration of FIG. 3 instead of the configuration of FIGS. 1 and 2.

The processing tank shown in FIG. 3 includes a housing 2 which is partitioned into a plurality of processing compartments 6A to 6J by main rollers 4, partition members 5 and the like. The compartments are filled with a processing solution 10 having a desilvering function such that the solutions in the respective compartments may be different in composition. Photosensitive material S is subjected to desilvering process by passing it serially through the compartments.

The processing tank of this organization allows the quantity of processing solution to be reduced.

Disposed above housing 2 are a loading roller 45 for carrying photosensitive material S into processing solution 10 and an unloading roller 47 for taking out photosensitive material S after development as shown in FIG. 3.

Main rollers 4 are disposed within housing 2 of the processing tank at predetermined intervals for feeding photosensitive material S forward. Some or all of main rollers 4 are driven for rotation by a desired drive means (not shown).

Partition members 5 are disposed between main rollers 4. Each partition member 5 is in contact with upper and lower main rollers 4 to divide the interior space of housing 2 into left and right sections.

The main rollers 4, partition members 5 and the inner wall of housing 2 define a plurality of processing compartments 6.

The number of compartments 6 in one housing 2 is 3 to 19, for example, and each compartment 6 may have a volume as previously defined.

Each partition member 5 serves as a boundary between left and right compartments while keeping sliding contact with the rotating main rollers 4 and is preferably formed of a material which is durable, undergoes no deformation, expansion or weakening upon contact with processing solution 10, and does not deteriorate the processing solution to adversely affect photographic properties. At least opposed end portions of partition member 5 are preferably formed of an elastic material to provide a sealing effect. In this regard, partition members 5 may be formed of elastomers including various rubber and flexible resins.

Below the main roller 4 at the lowermost stage are disposed reversal guides 30 and 30 for reversing the descending photosensitive material S for turning upward. A guide roller 31 is disposed between the reversal guides 30 and 30 for clamping photosensitive material S with main roller 4.

A guide 7 is attached to the inner wall of housing 2 in each compartment 6 for guiding photosensitive material S.

The guide 7 at the upper corner defines a gate 8 with main roller 4 through which photosensitive material S passes.

Figure 4:
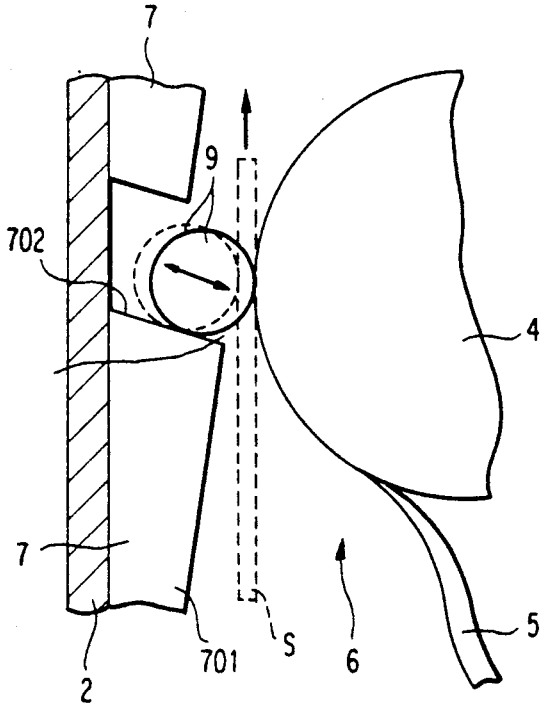
FIG. 4 is an enlarged cross section of a portion of the processing tank of FIG. 3 near the gate for passage of photosensitive material.

As best shown in FIG. 4, guide 7 has a guiding surface 701 which is tapered so as to lead photosensitive material S toward gate 8. The guide 7 at the upper end has an inclined surface 702 on which a free roller 9 to be described below rests.

The free roller 9 is situated at gate 8 as shutter means for opening and closing the gate. The free roller 9 has a diameter larger than the width of gate 8 and is allowed to freely tumble on inclined surface 702 at the upper end of guide 7.

During quiescent periods when no photosensitive sheet S travels, free roller 9 rolls down inclined surface 702 under gravity and comes in rolling engagement with main roller 4 (as shown by a solid line in FIG. 4), closing gate 8. During operating periods when photosensitive sheet S travels, free roller 9 is moved aside along inclined surface 702 by incoming photosensitive material S. The free roller 9 rolls while clamping photosensitive material S with the main roller 4 (as shown by broken lines in FIG. 4), allowing photosensitive material S to pass gate 8.

Any desired biasing means such as a spring (not shown) may be used for biasing free roller 9 toward main roller 4.

It is to be noted that free roller 9 need not close the gate 8 in a complete fluid tight manner, but may allow some flow of processing solution 10 through gate 8 as photosensitive material S passes the gate.

The main and free rollers 4 and 9 are preferably formed of a material which is durable, undergoes no deformation, expansion or weakening under the action of processing solution 10, and does not deteriorate processing solution 10 to adversely affect photographic properties, for example, various rubbers, resins, ceramics, and corrosion resistant metals (e.g., stainless steel, titanium, and Hastelloy), and a mixture thereof.

The main and free rollers on the circumference may be subject to various surface treatments.

In the illustrated embodiment, free roller 9 is moved aside by photosensitive material S reaching and passing there although drive means (not shown) may be provided for positively moving free roller 9 to controlledly open and close gate 8.

The shutter means used herein is not limited to the arrangement using free roller 9. Instead, any shutter arrangement (for example, a squeezer having a movable or resilient member) may be employed, optionally in combination with a free roller as mentioned above. Another form of shutter means contemplated herein is a labyrinth structure which permits passage of a photosensitive material, but prevents substantial passage of processing solution.

Disposed in proximity to the level of processing solution in compartments 6A and 6K in an uppermost zone of the tank 2 are an inlet port 23 for supplying the mother and replenisher of processing solution 10 into the tank and an outlet port 22 for maintaining the surface of processing solution 10 at a desired level in the tank.

Further, a selected compartment may be provided with an inlet port (not shown) for supplying a selected processing solution as in the embodiment of FIGS. 1 and 2.

With the above-illustrated arrangement, the photosensitive material S, after it has been developed or otherwise processed in accordance its processing procedure, is carried into processing solution 10 by loading roller 45, successively passed through compartments 6A to 6K for processing, and finally taken out by unloading roller 47.

Also in this case, the processing solution and its replenisher may be supplied in the same manner as in the processing tank of FIGS. 1 and 2 and preferably as a parallel flow.

Similar results are obtained with the above-illustrated arrangement for the same reason as described for the processing tank of FIGS. 1 and 2.

Figure 5:
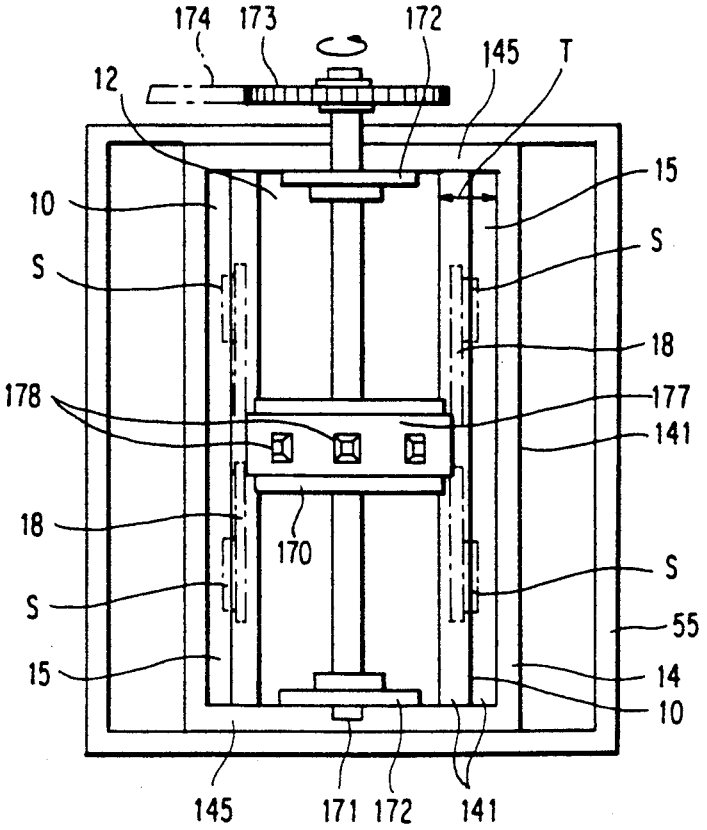
FIG. 5 is a plan view of a further embodiment of the processing tank used in the present invention.

The processing tank having a plurality of compartments partitioned therein according to the present invention may be further embodied as shown in FIG. 5.

The processing tank shown in FIG. 5 includes an outer tank in the form of a temperature controlled tank 55, a processing tank housing 14 disposed in tank 55, an inner wall member 12 disposed in housing 14, and a belt conveyor system comprising components 170–177.

The inner wall member 12 is situated in the interior of tank housing 14 at the center. A processing path 15 of a U shape in elevational cross section and a slit shape in transverse cross section is defined between the inside surface of tank housing 14 and the outside surface of inner tank wall member 12.

The path 15 is filled with a bleach-fixing solution 10.

In the practice of the invention, the slit-shaped processing path 15 along which photosensitive material S travels may have a gap (T) in transverse cross section of 0.2 to 50 mm, preferably 0.4 to 10 mm. With such a controlled gap, photosensitive material S can be smoothly passed through the path.

The U-shaped processing path 15 may have a height of about 30 to 180 cm from its arcuate bottom.

Partition members 141 are disposed in path 15 for partitioning the path.

Each partition member 141 includes a pair of blades each having a base attached to the path-defining wall and a thin portion whose thickness is gradually reduced toward the tip and which is deformable upon passage of photosensitive material S.

As shown in FIG. 5, two pairs of opposed blades are attached to the walls defining path 15 at two spaced locations spanning the location of the belt conveyor system.

Further, one of partition members 141 may be attached to the inner wall of tank housing 14 at a location opposed to the location of the belt conveyor system 17 as shown in FIG. 5, which is preferred in reducing the processing solution.

The partition members 141 may be formed of resilient materials such as various rubbers and resins.

The partition members are such that the thin blade portions closely contact each other at their tip during quiescent periods when no photosensitive material S travels, but are spread aside by the entry of photosensitive material S during operation for allowing passage of photosensitive material therethrough.

The number of compartments defined by locating partition members 141 may be about 5 to 30 along the entire path 15.

Further, partition members 141 of the type illustrated herein are effective not only in preventing the reverse flow of processing solution 10 during processing of photo-sensitive material S, but also in preventing the deterioration of processing solution 10 during quiescent periods.

Additional partition members 141 are located near the entrance and exit of processing path 15 and above the surface L of processing solution 10.

The belt conveyor system predominantly includes an upper wheel 170, a lower roller (not shown) below the upper wheel, an endless belt 177 trained around wheel 170 and the lower roller, and drive means for rotating wheel 170.

Brackets 172 and 172 are attached to left and right side walls 145 and 145 of tank housing 14 at the top and a rotating shaft 171 for wheel 170 is supported by brackets 172, 172 through bearings. The rotating shaft 171 has a sprocket wheel 173 secured thereto at one end, a chain 174 is trained around sprocket wheel 173 on the driven side and a sprocket wheel on the drive side (not shown), and rotating shaft 171 is rotated by drive means such as a motor (not shown) through the sprocket wheels and the chain. In turn, holes are formed in left and right side walls 145 and 145 at the bottom and a rotating shaft for the lower roller is inserted at the opposite ends into the holes so that the lower roller is supported for free pivotal motion. Below the lower roller, a processing space is defined between the outer surface of the lower roller and the arcuate inner wall surface of the tank housing.

The endless belt 177 is extended around wheel 170 and the lower roller approximately along their center line under tension so that the belt travels and turns along the predetermined orbit in a circulating manner with the rotation of wheel 170. A major portion of the orbit of endless belt 177 is situated within processing path 15.

The endless belt 177 on its outer surface is provided with a plurality of longitudinally equally spaced lugs 178 which are to engage with a hole in a leader 18 to be described below.

The leader 18 has a trailing end portion to which the leading ends of two photosensitive materials (films) S are secured by fasteners such as adhesive tape pieces and clips and a hole adapted to engage with one of lugs 178 on endless belt 177 so that photosensitive materials S may be transferred by driving endless belt 177.

The endless belt 177 may be formed of a material which is not attacked by the processing solution, for example, rubbers such as silicone rubber and various resins.

The leader 18 may be formed of a resinous material as used for the support of photosensitive material S, for example, various resins such as polyethylene and polyethylene terephthalate.

The processing tank further includes a loading reel (not shown) for admitting photosensitive material S into the entrance of processing path 15 and an unloading reel for taking out photosensitive material S from the exit of path 15.

Preferably, an inlet port (not shown) is located below the loading reel for supplying the mother and replenisher of the processing solution 10, and an outlet port (not shown) is located below the unloading reel for discharging the solution for maintaining the solution surface L. Further, a selected compartment may be provided with an inlet port (not shown) for supplying a selected processing solution as in the embodiment of FIGS. 1 and 2.

A reversal guide (not shown) is secured to the bottom inner wall of tank housing 14 for ensuring the reversing travel of leader 18 and photosensitive material S along the path.

It will be understood that the temperature controlled tank 55 may contain warm water for maintaining the processing temperature constant.

With the above-illustrated arrangement, the photosensitive material S, after it has been developed or otherwise processed in accordance its processing procedure, is carried into processing solution 10 by the loading roller, successively passed through various compartments by means of the belt conveyor system, and finally taken cut by the unloading roller.

The belt conveyor system ensures that photosensitive material travels along processing path 15 even if the path is of slit-shaped cross section.

Also in this case, the processing solution(s) and replenisher(s) may be supplied in the same manner as in the processing tank of FIGS. 1 and 2 and preferably as a parallel flow.

Similar results are obtained with the above-illustrated arrangement for the same reason as described for the processing tank of FIGS. 1 and 2.

It will be understood that the processing tank shown in FIG. 5 having a belt conveyor system invites a somewhat larger flow of processing solution than in the processing tank of the first embodiment.

More particularly, the flow of processing solution is about 1 to 30 ml/min. during quiescent periods (as compared with about 0.2 to 6 ml/min. for the processing tank of the first embodiment) and about 1 to 100 ml/min. during operation (as compared with about 0.2 to 30 ml/min. for the processing tank of the first embodiment).

For this reason, this processing tank is preferably operated such that a selected replenisher has been supplied into a selected compartment through its inlet port before photosensitive material is admitted into the tank and processed therein while continuing replenishment.

Such controlled operation ensures stable processing because the bleaching solution in the first compartment has a sufficiently high concentration of iron (III) chelate compound to complete bleaching within a short time and to prevent poor color recovery and because no trouble due to deposition of sulfides occurs with the fixing solution.

Figure 6:
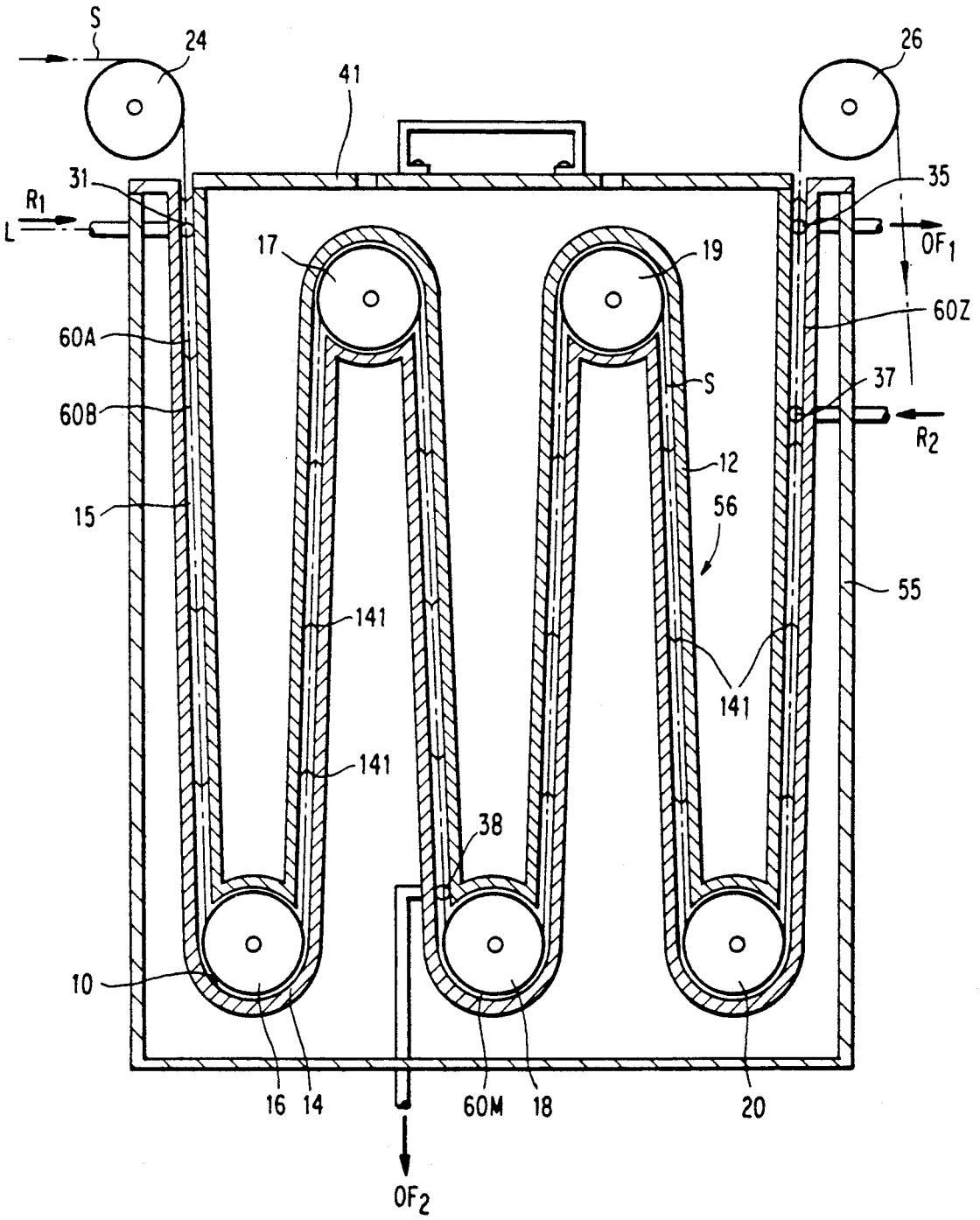
FIG. 6 is an elevational cross section of a further embodiment of the processing tank used in the present invention.

FIG. 6 shows another type of processing tank suitable for use in the practice of the method for processing silver halide color photosensitive material according to the present invention.

The processing tank shown in FIG. 6 is generally known as a slit type processing tank having a continuous processing path in the form of a processing path 15 having a slit shaped cross section. The processing path 15 is partitioned into a plurality of processing compartments 60A, 60B, . . . , 60M, . . . 60Z by partition members 141. With the compartments filled with a processing solution 10 having a desilvering function, a photosensitive material S is successively passed therethrough for processing.

The processing tank of this construction is able to reduce the quantity of processing solution 10 used.

The processing tank shown in FIG. 6 includes a housing 55 defining an upper opening and a lid 41 having an upper comb-shaped structure 56 suspended therefrom, the lid being fitted in the housing opening.

The upper structure 56 includes a plurality of substantially vertically extending upper structure ridges 12 and reels 16 to 20 disposed at the transitions between the structure ridges at the crest and the valley for feeding the photosensitive material.

The housing 55 includes tank wall members 14 disposed therein for defining the processing path 15 together with upper structure ridges 12. Therefore, upper structure ridges 12 and tank wall members 14 interdigitate to form processing path 15 in the form of a continuous winding slit having reels 16 to 20 disposed at the top and bottom turns thereof for feeding the photosensitive material.

In the present invention, the slit-shaped path 15 through which photosensitive material S travels may have a gap distance of 0.2 to 50 mm, preferably 0.4 to 10 mm.

The distance between the reels, for example, the distance of path 15 between reels 16 and 17 may be at least 5 cm, preferably at least 10 cm.

Outside the processing tank are located a loading reel 24 for admitting photosensitive material S into the entrance of processing path 15 and an unloading reel 26 for taking out photosensitive material S from the exit of path 15.

The processing path 15 is filled with processing solution 10 to a liquid level L and a replenisher for processing solution 10 is supplied during processing of photosensitive material S.

The processing solutions to be supplied herein are a bleaching solution as a solution having a bleaching function and a fixing solution as a solution having a fixing function.

Preferably, the bleaching replenisher is supplied from the side of the entrance of path 15 for the photosensitive material and the fixing replenisher supplied from the side of the exit of path 15 for the photosensitive material.

In the embodiment shown in FIG. 7, an inlet port 31 for bleaching replenisher R1 is located on the entrance side of path 15 for the photosensitive material (below reel 24) and an inlet port 37 for fixing replenisher R2 located in the final compartment 60Z.

Prior to processing, bleaching and fixing mother solutions are supplied through these inlet ports 31 and 37.

An outlet port 35 is located on the exit side of path 15 for the photosensitive material (below reel 26) and at the position of liquid level L for discharging processing solution 10 in an overflow manner.

An overflow port 38 is located in compartment 60M which is located at an approximate intermediate of path 15 for discharging a mixture of bleaching and fixing solutions in an overflow manner.

It is to be noted that this overflow port 38 is actually designed such that the solution will overflow at the same position as the liquid level given by overflow port 35 although such design is omitted from the figure.

Then bleaching replenisher R1 supplied through inlet port 31 flows through U-shaped path 15 in the same direction as the travel direction of photosensitive material S (parallel flow).

In turn, fixing replenisher R2 supplied through inlet port 37 flows in the reverse direction to the travel direction of photosensitive material S (counter flow).

Overflows $OF_1$ and $OF_2$ of processing solution are discharged through outlet port 35 and overflow port 38, respectively. The outlet port 35 is omitted as the case may be. The ratio $OF_1/OF_2$ is preferably up to 1/10, more preferably up to 1/100.

By passing the bleaching replenisher as a parallel flow, the bleaching efficiency is improved.

The passage of fixing replenisher as a counter flow is rather effective in improving processing efficiency. Since the blix process proceeds such that only fixation takes place in unexposed, undeveloped areas and bleaching first takes place and then fixation takes place in developed areas, the embodiment wherein bleaching is effected in the early half of the process and fixation is effected in the later half of the process is advantageous in processing efficiency.

Moreover, since little bleaching component is available at the later stage of desilvering process, the factor that increases washing load is eliminated and mild washing is acceptable.

The partition members 141 are located in processing path 15 to divide it into a plurality of compartments 60A, 60B, . . . , 60M, . . . 60Z.

Figure 7:
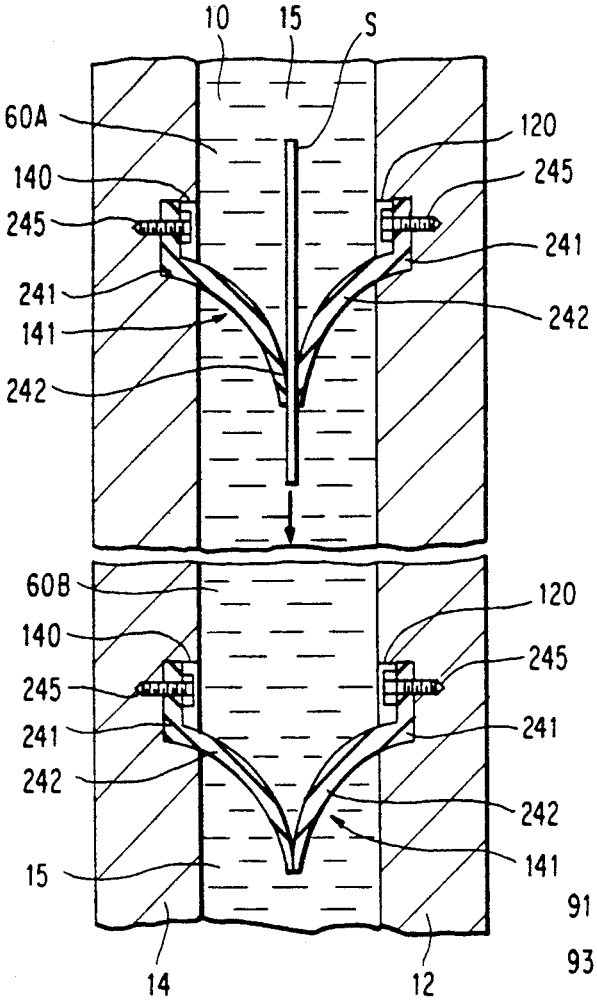
FIGS. 7 and 8 are enlarged elevational cross sections showing the construction of different partition members.

FIG. 7 is an elevational cross section showing partition members 141 of FIG. 6 in an enlarged scale.

As seen from the figure, each partition member 141 includes a flange 241 which is substantially, undeformable and a thin blade 242 which gradually decreases its thickness toward the tip and is easily deformable by the entry of photosensitive material S.

A pair of partition members 141 are provided such that one faces upper structure member 12 and the other faces tank wall member 14. That is, flanges 241 of partition members 141 are secured to recesses 120 and 140 in the surface of upper structure member 12 and tank wall member 14 on the path side by fasteners such as bolts 245. The blades 242 are in close contact at their tip for separating path 15 into upper and lower portions to define compartments 60A and 60B.

The partition members 141 are adapted to allow easy passage of photosensitive material S thereacross and prevent the reverse flow of processing solution 10.

The materials of which partition members 141 are made include diene rubbers such as NR, IR, SBR, BR, CR, NBR, NIR, and NBIR; non-diene rubbers such as IIR, EPM, EPDM, U, Q, and CM; various other rubbers such as fluoride rubber, silicone rubber, and urethane rubber; elastomers such as Thermolan, Rubalon, and Hytrel; flexible resins such as polyethylene, silicone resins, and Teflon, and mixtures of two or more of the foregoing materials. Among these, neoprene rubber, silicone rubber, butadiene rubber, neoprene-butadiene rubber, and flexible resins such as Teflon, nylon, and polyethylene are preferred because they are durable and have chemical resistance against the processing solution (undergo no deformation, expansion or weakening).

The partition members 141 are positioned during quiescent periods when no photosensitive material S travels (no replenishment of processing solution) such that blades 242 engage in close contact at their tip to shut off path 15 for interrupting the flow of processing solution 10 between the two adjoining compartments as shown in a lower portion of FIG. 7.

The sealing contact between blades 242 is generally provided by their own resiliency although it is possible to incorporate magnetic material in blades 242 (to make them from, for example, magnetic rubber) so that the blades are magnetically drawn to each other to provide a sealing force or enhance the sealing force.

With partition members 141 of such nature, blades 242 are in close contact at their tip when no photosensitive material S travels, but when photosensitive material S travels, moved aside by the entry of photosensitive material S, allowing passage of photosensitive material S as shown in an upper portion of FIG. 7.

The provision of partition members 141 ensures that little flow communication of processing solution occurs between adjoining compartments during quiescent periods, only some flow communication occurs during processing of photosensitive material S, and the photosensitive material is not exposed to the ambient air during processing, that is, is kept off from air contact, resulting in improved processing efficiency and a reduced quantity of processing solution to be replenished.

In the embodiment of FIG. 6, the flow of bleaching replenisher is in the same direction as the travel direction of photosensitive material and the flow of fixing replenisher is in the opposite direction.

Bleaching solution components are most fresh and have the highest concentration in the foremost stage compartment 60A where inlet port 31 is located, decrease their concentration in progress to later stage compartments, and have the lowest concentration in the last stage compartment 60Z.

In turn, fixing solution components are most fresh and have the highest concentration in the last stage compartment 60Z where inlet port 37 is located and have the lowest concentration in the foremost stage compartment 60A.

Therefore, throughout the processing path 15, the processing procedure goes like bleaching→bleach-fixation from the foremost stage compartment 60A to the last stage compartment 60Z, and the later stage of bleach-fixation process is substantially processing with a fixing solution. The procedure as a whole approaches bleaching→bleach-fixation →fixation.

Since the processing solution is discharged from compartment 60M as an overflow, the solution exhausted in both components of bleaching and fixing solutions can be efficiently discharged. This enables that bleaching and fixing replenishers be supplied from the entrance and exit sides for photosensitive material, and components of the solutions are kept in a graded concentration in the series of compartments, thus allowing the quantity of chemical agents used such as bleaching and fixing agents to be reduced.

A prior art technique which uses a bleach-fixing solution when it is desired to carry out both bleaching and fixation in a single bath fails to provide satisfactory photographic properties if the amount of bleaching agent used is reduced in order to overcome the previously mentioned problem, because bleaching becomes insufficient despite no sulfiding of fixing solution. The present invention ensures an efficient procedure of bleaching→bleach-fixation→fixation, succeeding in providing satisfactory photographic properties.

In turn, if bleaching and fixation steps are carried out in separate baths, sulfiding and other problems do not occur, but the apparatus having two baths is of large size.

FIG. 8 is an enlarged elevational cross section showing another example of the partition member. As shown in the figure, each partition member 99 includes a pair of rests 93 and 94 which are secured to the wall surfaces of upper structure member 12 and tank wall member 14 so as to face each other and a pair of rollers 91 and 92 resting on the upper inclined surface of rests 93 and 94 for rolling motion.

Figure 9:
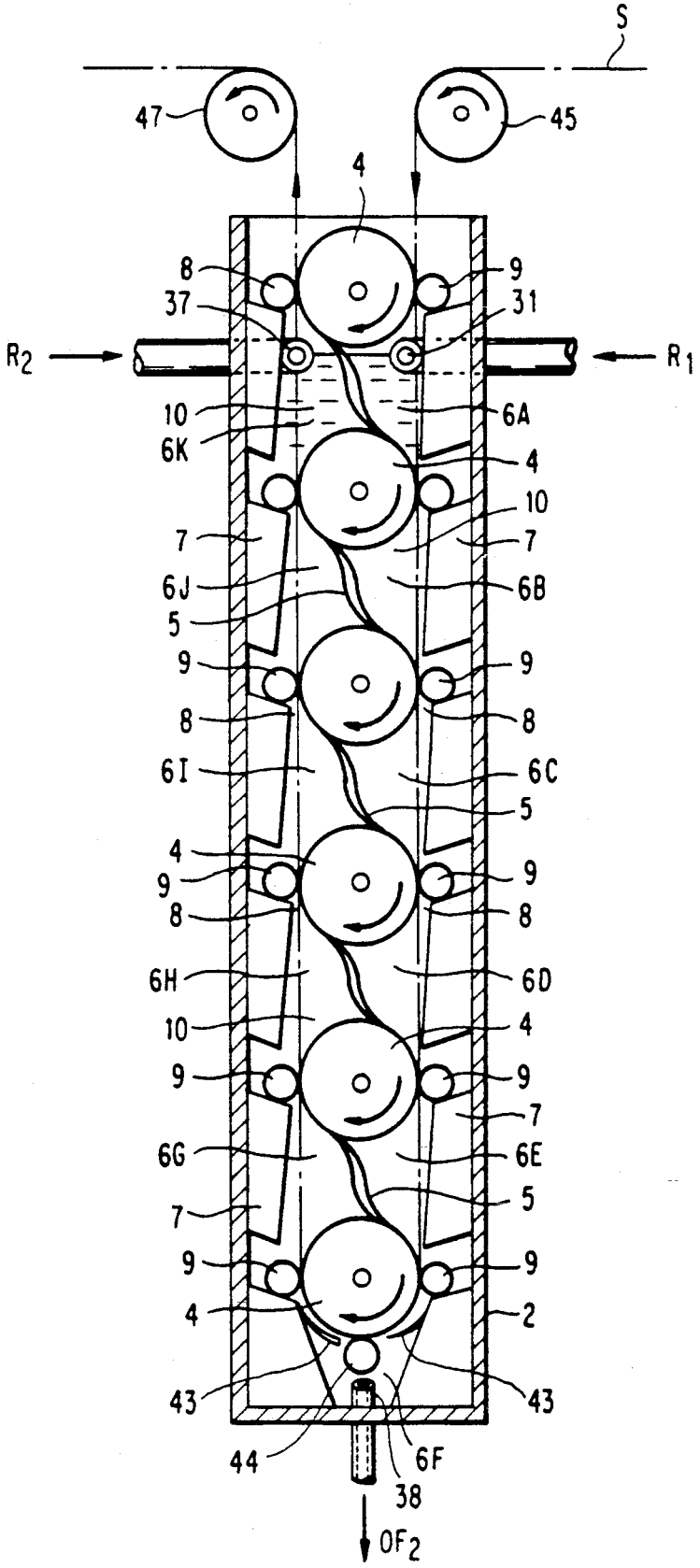
FIG. 9 is an elevational cross section of a further embodiment of the processing tank used in the present invention.

The partition members of this type operate such that during quiescent periods when no photosensitive material S travels, a pair of rollers 91, 92 roll down the inclined surfaces by gravity to abut on the outer periphery to provide a seal as shown in a lower portion of FIG. 9. The processing path 15 is thus interrupted such that little communication of processing solution 10 occurs between adjoining compartments 60A, 60B, . . . , 60Z.

As shown in an upper portion of FIG. 8, during processing when photosensitive material S passes across partition members 99, rollers 91, 92 are moved upward along the inclined surfaces as photosensitive material S advances between the rollers. The photosensitive material travels past rollers 91, 92 in the direction of an arrow while causing the rollers to rotate.

After photosensitive material S leaves partition members 99, partition members 99 resume the original state shown in a lower portion of FIG. 8 wherein rollers 91, 92 come in close sealing contact on their outer periphery, interrupting the communication of processing solution 10 again.

Similar advantages and benefits as in the previous embodiments are obtained with partition members 99 of this type.

The rollers 91, 92 are preferably formed of a material which is durable and chemically resistant against processing solution 10, and does not deteriorate processing solution to adversely affect photographic properties. Preferred examples of such material include natural and synthetic rubbers such as neoprene, butadiene, and neoprene-butadiene rubbers, various resins such as polyethylene, polypropylene, ABS resins, polyamides, polyacetal, polyphenylene oxide, polyesters, rigid polyvinyl chloride and phenolic resins, ceramics such as alumina, and corrosion resistant metals such as stainless steel, titanium, and Hastelloy, and a mixture thereof.

The rollers 91, 92 on the circumference may be subject to various surface treatments. For example, Teflon, nylon, fluoride resin or the like may be coated to the cylindrical surface of rollers. Alternatively, smoothing treatment as by electrolytic polishing and electrolytic plating may be applied to the cylindrical surface of rollers which are formed of metal, and fluoride treatment may be applied to the cylindrical surface of rollers which are formed of ceramic.

Mutual engagement of rollers 91, 92 is not limited to the downward motion along the inclined surface under gravity and biasing means such as springs (not shown) may be used to bias rollers toward one another.

Although rollers 91, 92 are moved away by the passage of photosensitive material S in the illustrated embodiment, drive means (not shown) for moving away the rollers may be provided for opening and closing the area where the photo-sensitive material is to pass.

It is to be noted that the partition members 141 or 99 may be spaced 10 to 80 cm, for example, in a longitudinal direction of path 15.

Of course, the construction of partition members is not limited to the foregoing examples.

The processing tank used herein may additionally include a replenishing tank, agitating means, and circulating means if desired, although these are not shown.

The housing 55 is filled with warm water for maintaining the temperature of processing solution constant.

With the apparatus thus constructed, photosensitive material S is admitted into processing path 15 filled with processing solution through reel 24, for example, by feeding forward a leader tape to draw the photosensitive material, successively passed through compartments 60A, . . . along path 15 through reels 16 to 20, then taken out of path 15, and finally delivered to a subsequent step through reel 26.

In the present invention, photosensitive material S does not contact air, especially the ambient air during its passage through the processing path. This feature has the following advantages.

1) Only a substantial processing time is needed because the time taken for crossover movement between compartments is eliminated.

2) The present invention eliminates the problem that upon entry of a photosensitive material which has been in the ambient atmosphere into a fixing or bleach-fixing solution, it is accompanied by air which will cause oxidation of fixing components deteriorating the solution. The quantity of respective solutions replenished can be reduced in this respect too.

In regard of 1), although a prior art technique requires at least two baths, bleaching and bleach-fixing tanks in order to accommodate the process of bleaching→bleach-fixing and at least three baths, bleaching, bleach-fixing and fixing tanks in order to accommodate the process of bleaching→bleach-fixing→fixation, the present invention can carry out these processes in a single tank so that the apparatus becomes compact.

FIG. 9 illustrates a modified version of the processing tank of FIG. 3 wherein an inlet port 31 is located near the liquid level of processing solution in compartment 6A on the photosensitive material entrance side in an upper zone of housing 2 for supplying a bleaching replenisher R1, another inlet port 37 is located in compartment 6K on the photosensitive material exit side for supplying a fixing replenisher R2, and an overflow port 38 is located in compartment 6F at an approximate intermediate position of the continuous processing path for discharging an overflow $OF_2$ in the form of a mixture of bleaching and fixing solutions. It is to be noted that overflow port 38 is located so as to establish the same liquid level with inlet ports 31 and 37.

Figure 10:
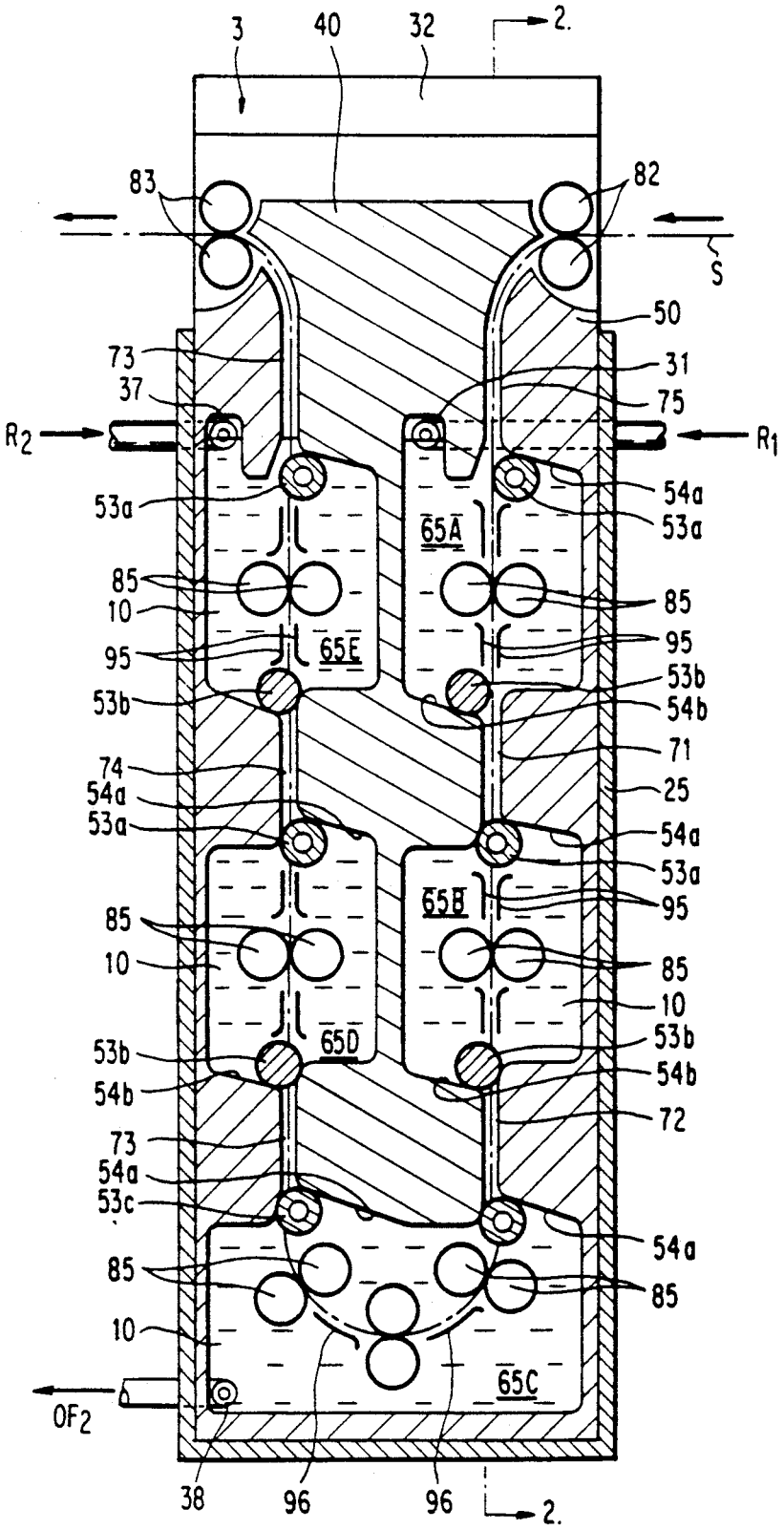
FIG. 10 is an elevational cross section of a still further embodiment of the processing tank used in the present invention.

FIG. 10 illustrates a still further embodiment of the processing tank used in the practice of the invention.

This processing tank is a modified version of the embodiment of FIGS. 1 and 2 wherein an inlet port 31 is located near the liquid level in compartment 65A on the photosensitive material entrance side in an upper zone of the tank for supplying a bleaching replenisher R1, another inlet port 37 is located in compartment 65E on the photo-sensitive material exit side for supplying a fixing replenisher R2, and an overflow port 38 is located in compartment 65C at an approximate intermediate position of the continuous processing path for discharging an overflow $OF_2$ in the form of a mixture of bleaching and fixing solutions as in the embodiment just described above.

The desilvering process in these embodiments should preferably assume a process of bleaching→bleach-fixation (or bleaching→bleach-fixation→fixation) by supplying a bleaching solution from the compartment on the photo-sensitive material entrance side because the benefits of the invention become more outstanding in such a process.

In the practice of the invention, color development is carried out prior to the desilvering process and water washing and/or stabilization carried out subsequent to the desilvering process.

Further, the desilvering process may be combined with additional steps using a pre-hardening bath, neutralizing bath, first development (black-and-white development) bath, and image stabilizing bath, if desired.

In the practice of the invention, after desilvering is carried out in the continuous processing path as previously mentioned, water washing and/or stabilization may be carried out in a continuous manner in succession to the desilvering process.

Figure 11:
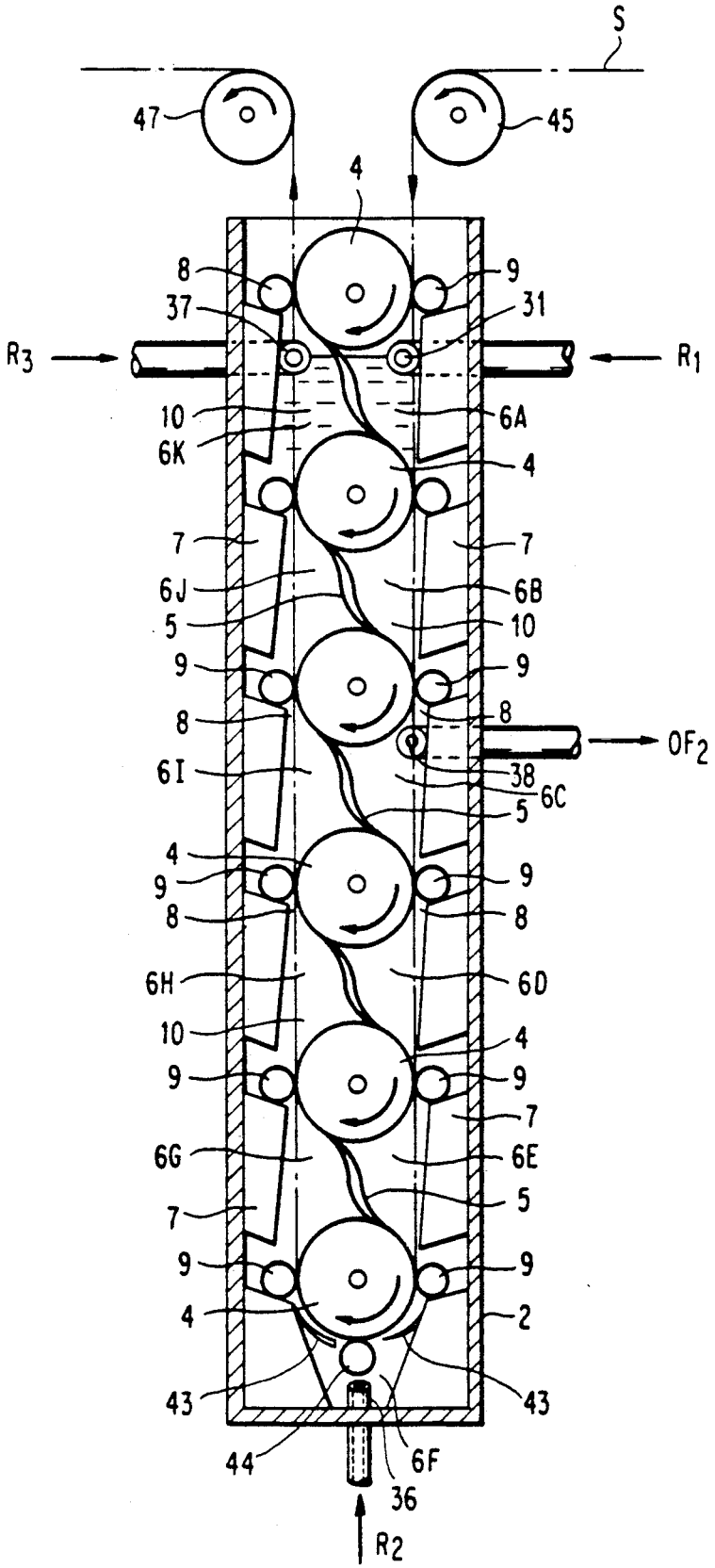
FIG. 11 is an elevational cross section of a yet further embodiment of the processing tank used in the present invention.

FIG. 11 illustrates a processing tank for use in the practice of such a process.

The processing tank of FIG. 11 is of essentially the same structure as FIG. 3. The tank includes an inlet port 31 located in compartment 6A on the photosensitive material entrance side for supplying a bleaching replenisher R1, an inlet port 36 located in compartment 6F for supplying a fixing replenisher R2, and an inlet port 37 located in compartment 6K on the photosensitive material exit side for supplying a washing replenisher R3.

An overflow port 38 is located in compartment 6C for discharging an overflow $OF_2$ in the form of a mixture of bleaching and fixing solutions and washing water.

This processing tank is therefore adapted to carry out a process of bleaching→bleach-fixation (→fixation)→washing.

This processing tank can carry out a process of desilvering→washing in a single tank, leading to a further compact apparatus and a shorter processing time.

The same benefits as previously described are achieved in the desilvering process while the quantity of processing solutions including wash water replenished and hence, the quantity of solution discharged can be reduced.

If it is desired to carry out water washing by providing a separate wash tank, the washing step in the above-mentioned overall process can be a pre-washing step.

In this case, the overall process is bleaching→bleach-fixation (→fixation)→pre-washing. The pre-washing step not only reduces the washing load in a subsequent step, but also prevents the fixing solution from being dragged out to the subsequent step, reducing the quantity of fixing replenisher supplied.

It is to be noted that the wash water forms a counter flow in this embodiment with an increased washing efficiency.

Figure 12:
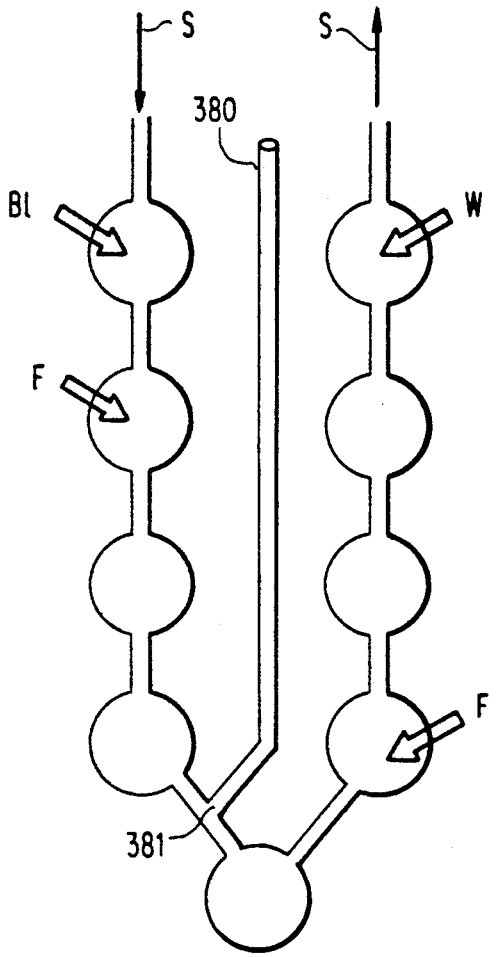
FIGS. 12 and 13 are schematic illustrations of different patterns applicable to the processing tank used in the present invention.
Figure 13:
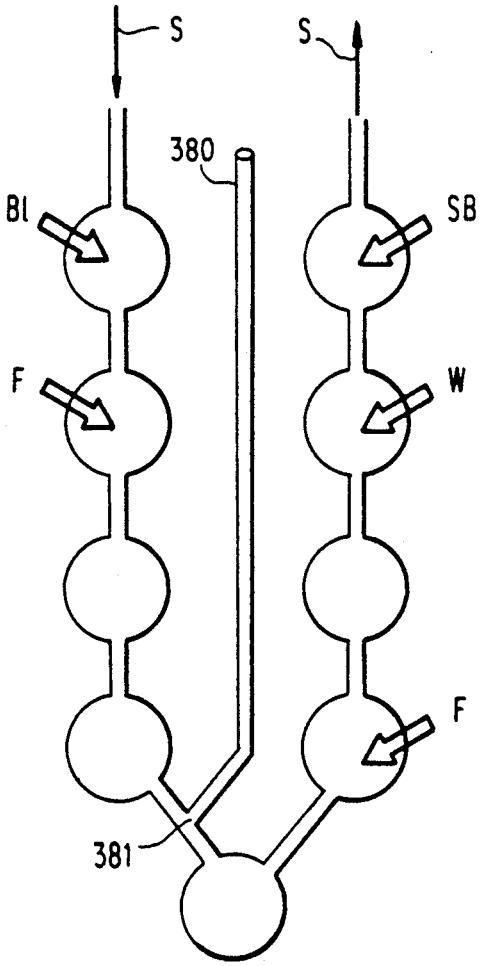

Such a processing tank may also be embodied as the arrangements shown in FIGS. 12 and 13.

The processing tanks of FIGS. 12 and 13 are of essentially the same structure as the processing tank of FIGS. 1 and 2, and only the contour of compartments and channels is schematically illustrated in FIGS. 12 and 13.

The processing tank of FIG. 12 is constructed such that bleaching replenisher B1 is delivered into the first compartment, fixing replenisher F into the second and sixth compartments, and washing replenisher W into the ninth compartment, while the solution is discharged from the channel 381 between the fourth and fifth compartments through an overflow conduit 380.

The processing tank of FIG. 13 is of the same construction as the tank of FIG. 12 except that washing replenisher W is delivered into the eighth compartment and stabilizing replenisher SB delivered into the ninth compartment.

In such a processing system, fixing solution F supplied into the second compartment is more effective in washing out the developing agent and the oxidizing agent once incorporated in the emulsion layer, thereby inhibiting occurrence of thermostains after processing.

The processing method using any one of the processing tanks of the types shown in FIGS. 6 to 13 is carried out by supplying a processing solution having at least a bleaching function at the entrance side of the continuous processing path, supplying a processing solution having at least a fixing function at the exit side of the path, and discharging the solution through an outlet port at an intermediate of the path.

The entrance of the continuous processing path is a location in the path where a photosensitive material is admitted into the processing solution, and the exit is a location in the path where the photosensitive material is taken out of the solution.

The entrance side of the continuous processing path is a region of the path which is located upstream of the outlet (overflow) port at an intermediate of the path. The processing solution having a bleaching function supplied at such a location normally forms a parallel flow.

In turn, the exit side of the continuous processing path is a region of the path which is located downstream of the outlet (overflow) port. The processing solution having a fixing function supplied at such a location normally forms a counter flow.

In this way, a first region filled with a processing solution having a substantial bleaching function, a second region filled with a processing solution having a substantial bleaching and fixing functions, and a third region filled with a processing solution having a substantial fixing function are serially defined in the continuous processing path.

It is to be noted that the objects may be achieved simply by supplying a processing solution having at least a bleaching function, typically bleaching solution on the entrance side of the continuous processing path and optionally supplying a processing solution having another desilvering function, typically fixing solution through another inlet port as shown in FIGS. 12 and 13. Then, it is advantageous to supply a fixing solution in the second region on the photosensitive material entrance side as shown in FIGS. 12 and 13.

In turn, a processing solution having at least a fixing function, typically fixing solution may be supplied on the exit side of the path.

On the side downstream of the processing solution supply locations, a processing solution having a washing function, typically wash water and a processing solution having a stabilizing function, typically stabilizer may be supplied to create regions filled with wash water and stabilizer.

The processing solutions having a desilvering function used in the practice of the invention include bleaching, bleach-fixing and fixing solutions, which are now described.

The bleaching and bleach-fixing solutions used herein contain bleaching agents which include ferric ion complexes or complexes of ferric ion with chelating agents such as aminopolycarboxylic acids, aminopolyphosphonic acids, and salts thereof. The aminopolycarboxylic and aminopolyphosphonic salts are salts of aminopolycarboxylic acids and aminopolyphosphonic acids with alkali metals, ammonium, and water-soluble amines. The alkali metals include sodium, potassium, and lithium, and the water-soluble amines include alkyl amines such as methylamine, diethylamine, triethyl amine, and butylamine, cycloaliphatic amines such as cyclohexylamine, aryl amines such as aniline and m-toluidine, and heterocyclic amines such as pyridine, morpholine, and piperazine.

Typical, non-limiting examples of the chelating agents such as aminopolycarboxylic acids, aminopolyphosphonic acids, and salts thereof include ethylenediamine tetraacetic acid, disodium ethylenediamine tetraacetate, diammonium ethylenediamine tetraacetate, tetra(trimethylammonium) ethylenediamine tetraacetate, tetrapotassium ethylenediamine tetraacetate, tetrasodium ethylenediamine tetraacetate, trisodium ethylenediamine tetraacetate, diethylenetriamine pentaacetic acid, pentasodium diethylenetriamine pentaacetate, ethylenediamine-N-(β-oxyethyl)-N,N',N'-triacetic acid, trisodium ethylenediamine-N-(β-oxyethyl)-N,N',N'-triacetate, triammonium ethylenediamine-N-(β-oxyethyl) -N,N',N'-triacetate, 1,2-diaminopropane tetraacetic acid, disodium 1,2-diaminopropane tetraacetate, 1,3-diaminopropane tetraacetic acid, diammonium 1,3-diaminopropane tetraacetate, nitrilotriacetic acid, trisodium nitrilotriacetate, cyclohexanediamine tetraacetic acid, disodiun cyclohexanediamine tetraacetate, iminodiacetic acid, dihydroxyethylglycine, ethyl ether diamine tetraacetic acid, glycol ether diamine tetraacetic acid, ethylenediamine tetrapropionic acid, phenylenediamine tetraacetic acid, 1,3-diaminopropanol -N,N,N',N'-tetramethylenephosphonic acid, ethylenediamine -N,N,N',N'-tetramethylenephosphonic acid, and 1,3-propylenediamine-N,N,N',N'-tetramethylenephosphonic acid.

The iron ion complex salts may be used in the form of complex salts or formed in a solution by supplying a ferric salt such as ferric sulfate, ferric silver chloride, ferric nitrate, ferric sulfate ammonium, and ferric phosphate and a chelating agent such as aminopolycarboxylic acids and phosphonocarboxylic acids. For the complex salt form addition, one or more complex salts may be used. Where a complex salt is formed in a solution from a ferric salt and a chelating agent, one or more ferric salts may be used. In either case, the chelating agent may be used in excess amount than necessary to form a ferric ion complex salt. The preferred iron complexes are iron aminopolycarboxylate complexes.

The bleaching agent is generally added in an amount of 0.02 to 1 mol/liter, preferably 0.06 to 0.6 mol/liter.

The bleaching and bleach-fixing solutions may contain bleaching promoters if desired. Among many known examples of the useful bleaching promoters, compounds having a mercapto group or disulfide group are preferred for enhanced promotion, especially the compounds described in U.S. Pat. No. 3,893,858, German Patent No. 1,290,812, and Japanese Patent Application Unexamined Publication (JP-A) No. 95630/1978.

The bleaching and bleach-fixing solutions may further contain re-halogenating agents, for example, bromides (e.g., potassium bromide, sodium bromide and ammonium bromide), chlorides (e.g., potassium chloride, sodium chloride and ammonium chloride), and iodides (e.g., ammonium iodide). If desired, there may be added at least pH buffering agent selected from inorganic acids, organic acids and alkali metal and ammonium salts thereof, for example, boric acid, borax, sodium metaborate, acetic acid, sodium acetate, sodium carbonate, potassium carbonate, phosphorous acid, phosphoric acid, sodium phosphate, citric acid, sodium citrate, and tartaric acid, as well as anti-corrosion agents such as ammonium nitrate and guanidine.

The bleach-fixing and fixing solutions used herein contain fixing agents which are selected from well-known fixing agents which are water-soluble silver halide dissolving agents, for example, thiosulfates such as sodium thiosulfate and ammonium thiosulfate; thioether compounds such as ethylenebisthioglycolic acid and 3,6-dithia-1,8-octanediol, and thioureas, alone or in admixture of two or more. Also useful are special bleach-fixing solutions based on a fixing agent combined with a large amount of a halide such as potassium iodide as disclosed in JP-A 155354/1976. Preferred are thiosulfates, especially ammonium thiosulfate. The fixing agent is generally added in an amount of 0.3 to 2 mol/liter.

The bleach-fixing and fixing solutions used herein preferably has a pH in the range of 3 to 10, more preferably 5 to 9. A lower pH value below the range will enhance the desilvering ability, but promote the fatigue of the solution and conversion of cyan dyes into leuco form whereas a higher pH value above the range will retard desilvering and often leave stains. For pH adjustment, hydrochloric acid, sulfuric acid, nitric acid, acetic acid, bicarbonates, ammonia, potassium hydroxide, sodium hydroxide, sodium carbonate, potassium carbonate or the like may be added if desired.

The bleach-fixing solution may further contain various brighteners, defoaming agents or surface active agents, polyvinyl pyrrolidone, and organic solvents such as methanol.

The bleach-fixing and fixing solutions used herein may further contain preservatives in the form of sulfite ion-releasing compounds, for example, sulfites (e.g., sodium sulfite, potassium sulfite, and ammonium sulfite), bisulfites (e.g., sodium bisulfite, potassium bisulfite, and ammonium bisulfite), and metabisulfites (e.g., sodium metabisulfite, potassium metabisulfite, and ammonium metabisulfite). These compounds are added in amounts of about 0.02 to 0.50 mol/liter, more preferably 0.04 to 0.40 mol/liter calculated as sulfite ions. Although sulfites are common preservatives, ascorbic acid, carbonyl bisulfite adducts or carbonyl compounds may also be used.

In addition, buffer agents, brighteners, chelating agents, bactericides and other agents may be added if necessary.

The color developer used in the development prior to the processing according to the present invention is most often an alkaline aqueous solution containing a color developing agent. The color developing agents used herein are well-known primary aromatic amine developing agents, for example, phenylene diamines (e.g., 4-amino-N,N-diethylaniline, 3-methyl-4-amino-N,N-diethylaniline, 4-amino-N -ethyl-N-β-hydroxyethylaniline, 3-methyl-4-amino-N-ethyl-N-β-hydroxylethylaniline, 3-methyl-4-amino-N-ethyl-N-β-methanesulfonamidethylaniline, and 4-amino-3-methyl-N-ethyl-N-β-methoxylethylaniline).

The color developer may further contain pH buffer agents, development retarders and antifoggants.

If desired, there may be added water softeners, preservatives, development promoters, dye-forming couplers, competitive couplers, chemical fogging agents, auxiliary developing agents, thickeners, polycarboxylic acid chelating agents, antioxidants, alkali agents, solution aids, surface active agents, and defoaming agents.

The processing temperature at which the color developer is used preferably ranges from 30 to 50° C., more preferably from 33 to 42° C.

The development may be of a replenishing mode requiring the replenishment of developer or a non-replenishing mode.

The wash water used in the washing step may be water optionally containing well-known additives. There may be added, for example, chelating agents such as inorganic phosphoric acid, aminopolycarboxylic acids, and organic phosphoric acids, fungicides and bactericides for controlling the growth of bacteria and algae, film hardeners such as magnesium salts and aluminum salts, and surface active agents for reducing drying load or preventing drying streaks. Also useful are the compounds described in L. E. West, "Water Quality Criteria", Phot. Sci. and Eng., vol. 9, No. 6, 344–359 (1965).

The stabilizing solution used in the stabilization step is a solution for stabilizing dye images. For example, solutions having a buffering function at pH 3–6 and solutions containing aldehydes (e.g., formalin) may be used. The stabilizing solution may contain brighteners, chelating agents, fungicides, bactericides, film hardeners, surface active agents or the like if desired.

The photosensitive materials which can be processed in the practice of the present invention are any desired types of photosensitive material including color negative films, color reversal films, color photographic paper, color positive films, and color reversal photographic paper as well as printing photographic photosensitive material and microphotographic photosensitive material.

The invention is especially advantageous in processing color negative films.

EXAMPLES

Examples of the present invention are given below by way of illustration and not by way of illustration.

EXAMPLE 1

A multi-layer color photosensitive material was prepared by coating a primed cellulose triacetate film support with the following coating compositions in the layer arrangement shown below.

Photosensitive Layer Composition

Each of the layers has the following composition, in which the amount of each ingredient coated is expressed in gram per square meter ($g/m^2$) unit, and the amount of silver halide coated expressed by calculating the amount of silver coated. The amount of sensitizing dye coated is expressed in mol per mol of silver halide in the same layer.

| | |
|---|---|
| 1st layer: anti-halation layer | |
| Black colloid silver | Ag 0.18 |
| Gelatin | 0.40 |
| 2nd layer: intermediate layer | |
| 2,5-di-t-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| 3rd layer: first red-sensitive emulsion layer | |
| Monodispersed silver iodobromide emulsion (AgI 6 mol %, mean grain diameter 0.6 μm, coefficient of variation of grain diameter 0.15) | Ag 0.55 |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| Sensitizing dye IV | $4.0 \times 10^{-5}$ |
| EX-2 | 0.350 |
| HBS-1 | 0.005 |
| EX-10 | 0.020 |
| Gelatin | 1.20 |
| 4th layer: second red-sensitive emulsion layer | |
| Plate silver iodobromide emulsion (AgI 10 mol %, mean grain diameter 0.7 μm, mean aspect ratio 5.5, mean thickness 0.7 μm) | Ag 1.0 |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| Sensitizing dye IV | $3.0 \times 10^{-5}$ |
| EX-2 | 0.400 |
| EX-3 | 0.050 |
| EX-10 | 0.015 |
| Gelatin | 1.30 |
| 5th layer: third red-sensitive emulsion layer | |
| Silver iodobromide emulsion (AgI 16 mol %, mean grain diameter 1.1 μm) | Ag 1.60 |
| Sensitizing dye IX | $5.4 \times 10^{-5}$ |
| Sensitizing dye II | $1.4 \times 10^{-5}$ |
| Sensitizing dye III | $2.4 \times 10^{-4}$ |
| Sensitizing dye IV | $3.1 \times 10^{-5}$ |
| EX-3 | 0.240 |
| EX-4 | 0.120 |
| HBS-1 | 0.22 |
| HBS-2 | 0.10 |
| Gelatin | 1.63 |
| 6th layer: intermediate layer | |
| EX-5 | 0.040 |
| HBS-1 | 0.020 |
| Gelatin | 0.80 |
| 7th layer: first green-sensitive emulsion layer | |
| Plate silver iodobromide emulsion (AgI 6 mol %, mean grain diameter 0.6 μm, mean aspect ratio 6.0, mean thickness 0.15 μm) | Ag 0.40 |
| Sensitizing dye V | $3.0 \times 10^{-5}$ |

-continued

| | |
|---|---|
| Sensitizing dye VI | $1.0 \times 10^{-4}$ |
| Sensitizing dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-4 | 0.010 |
| Gelatin | 0.75 |
| 8th layer: second green-sensitive emulsion layer | |
| Monodispersed silver iodobromide emulsion (AgI 9 mol %, mean grain diameter 0.7 μm, coefficient of variation of grain diameter 0.18) | Ag 0.80 |
| Sensitizing dye V | $2.1 \times 10^{-5}$ |
| Sensitizing dye VI | $7.0 \times 10^{-5}$ |
| Sensitizing dye VII | $2.6 \times 10^{-4}$ |
| EX-6 | 0.180 |
| EX-8 | 0.010 |
| EX-1 | 0.008 |
| EX-7 | 0.012 |
| HBS-1 | 0.160 |
| HBS-4 | 0.008 |
| Gelatin | 1.10 |
| 9th layer: third green-sensitive emulsion layer | |
| Silver iodobromide emulsion (AgI 12 mol %, mean grain diameter 1.0 μm) | Ag 1.2 |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| EX-6 | 0.065 |
| EX-11 | 0.030 |
| EX-1 | 0.025 |
| HBS-1 | 0.25 |
| HBS-2 | 0.10 |
| Gelatin | 1.74 |
| 10th layer: yellow filter layer | |
| Yellow colloid silver | Ag 0.05 |
| EX-5 | 0.08 |
| HBS-3 | 0.03 |
| Gelatin | 0.95 |
| 11th layer: first blue-sensitive emulsion layer | |
| Plate silver iodobromide emulsion (AgI 6 mol %, mean grain diameter 0.6 μm, mean aspect ratio 5.7, mean thickness 0.15 μm) | Ag 0.24 |
| Sensitizing dye VII | $3.5 \times 10^{-4}$ |
| EX-9 | 0.85 |
| EX-8 | 0.12 |
| HBS-1 | 0.28 |
| Gelatin | 1.28 |
| 12th layer: second blue-sensitive emulsion layer | |
| Monodispersed silver iodobromide emulsion (AgI 10 mol %, mean grain diameter 0.8 μm, coefficient of variation of grain diameter 0.16) | Ag 0.45 |
| Sensitizing dye VIII | $2.1 \times 10^{-4}$ |
| EX-9 | 0.20 |
| EX-10 | 0.015 |
| HBS-1 | 0.03 |
| Gelatin | 0.46 |
| 13th layer: third blue-sensitive emulsion layer | |
| Silver iodobromide emulsion (AgI 14 mol %, mean grain diameter 1.3 μm) | Ag 0.77 |
| Sensitizing dye VIII | $2.2 \times 10^{-4}$ |
| EX-9 | 0.20 |
| HBS-1 | 0.07 |
| Gelatin | 0.69 |
| 14th layer: first protective layer | |
| Silver iodobromide emulsion (AgI 1 mol %, mean grain diameter 0.07 μm) | Ag 0.5 |
| U-4 | 0.11 |
| U-5 | 0.17 |
| HBS-1 | 0.90 |
| Gelatin | 1.00 |
| 15th layer: second protective layer | |
| Polymethyl acrylate particles (diameter ~1.5 μm) | 0.54 |
| S-1 | 0.15 |
| S-2 | 0.05 |

-continued
| | |
|---|---|
| Gelatin | 0.72 |
In addition to the above-listed ingredients, each layer contained gelatin hardening agent H-1 and a surface active agent.
U-1
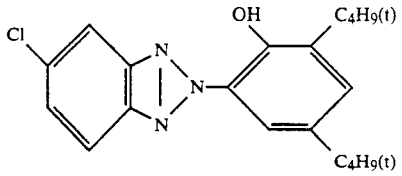
U-2
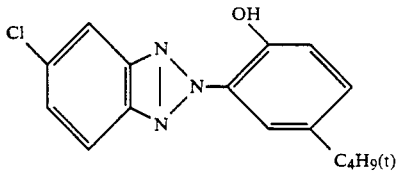
U-3
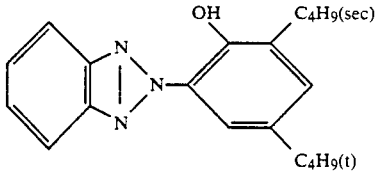
U-4
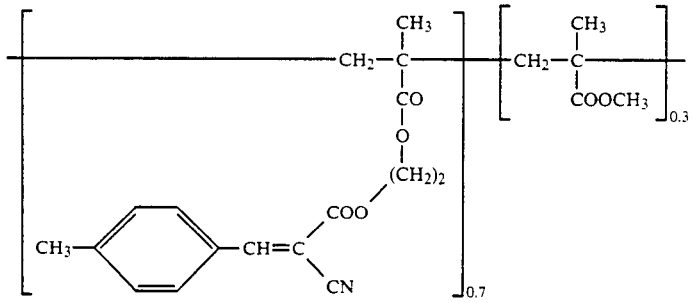
U-5
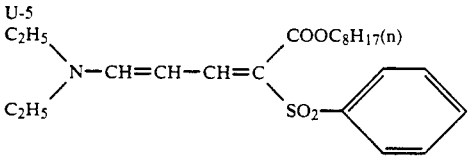
EX-1
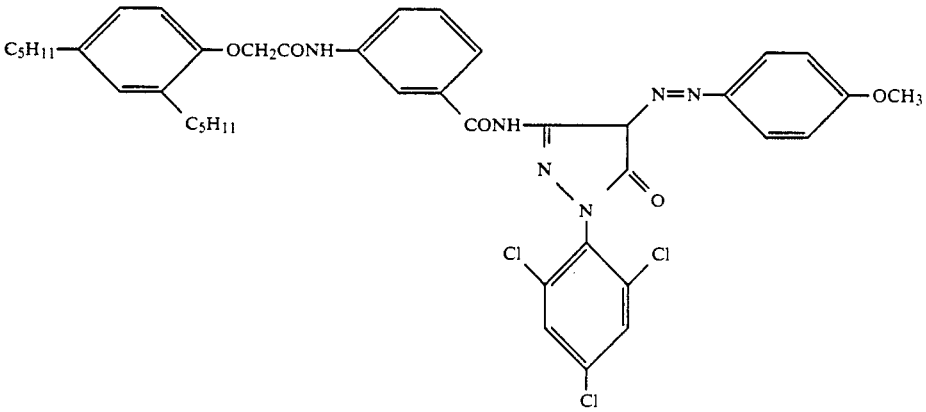
EX-2

-continued
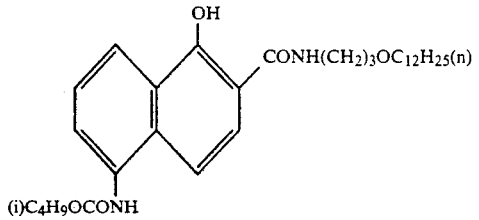
EX-3
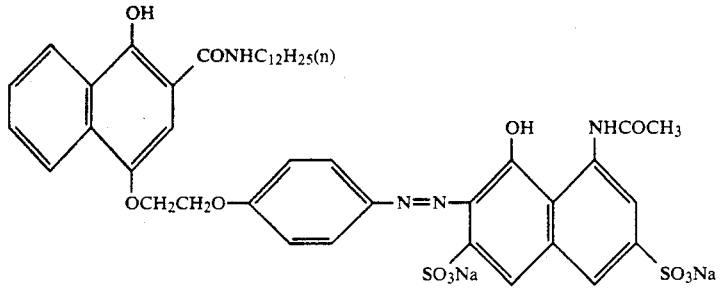
EX-4
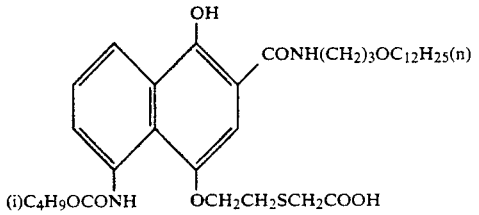
EX-5
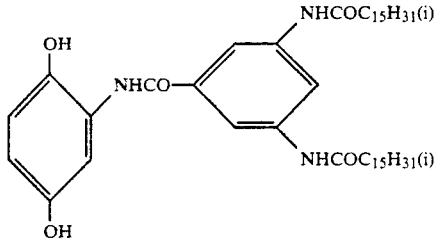
EX-6
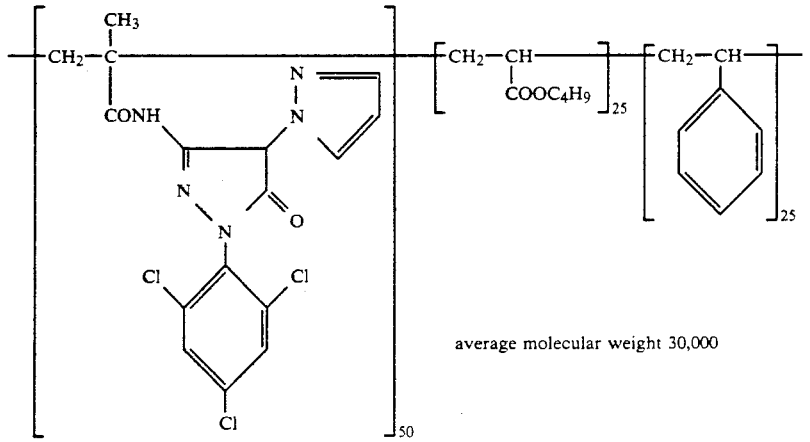
EX-7

-continued
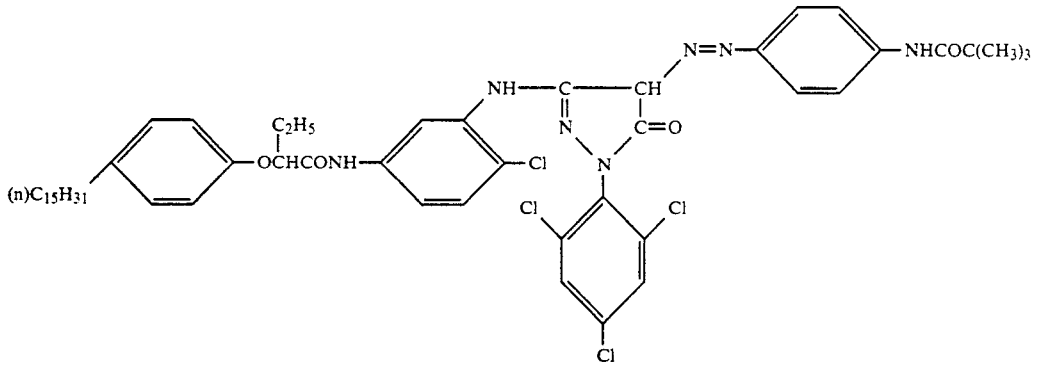
EX-8
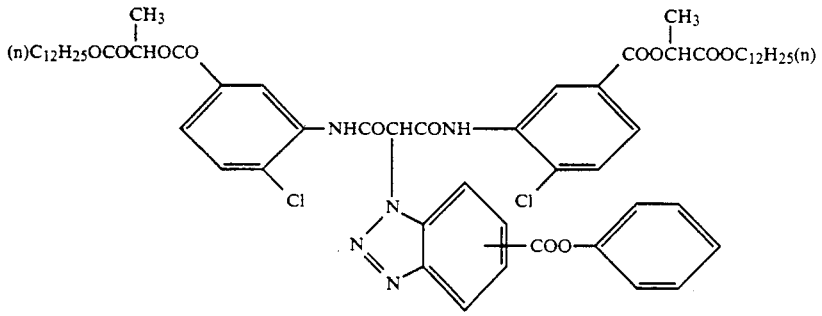
EX-9
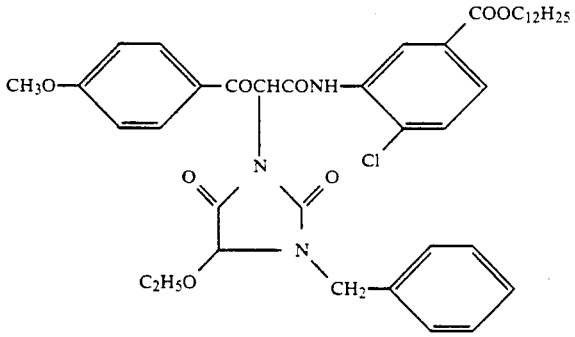
EX-10
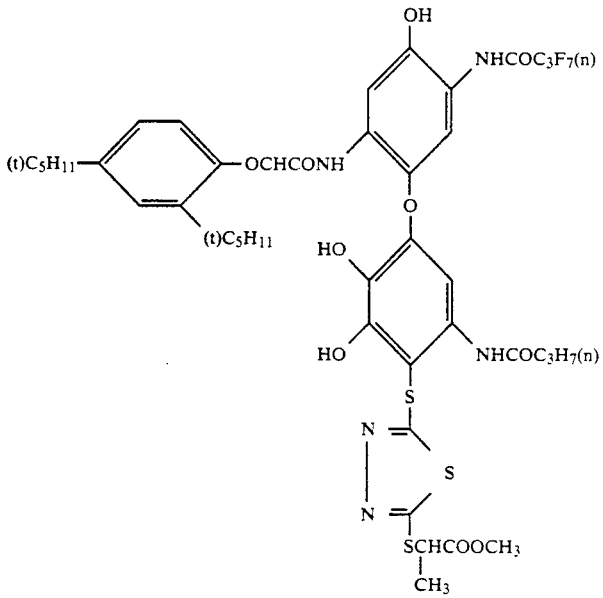

-continued
EX-11
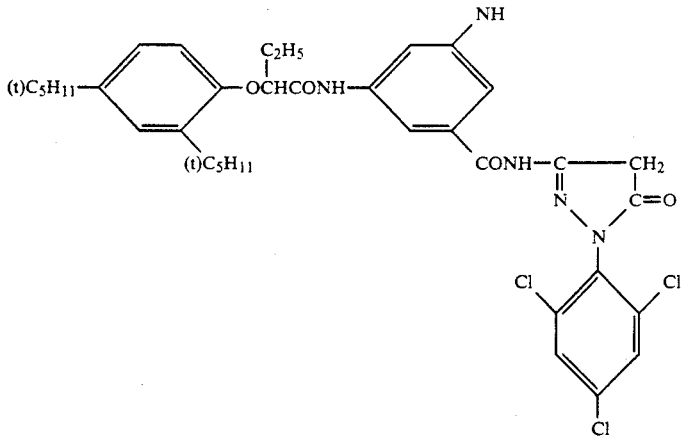
EX-12
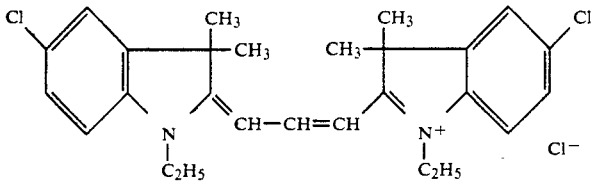
S-1
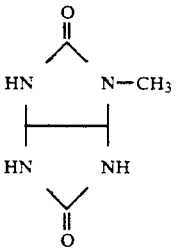
S-2
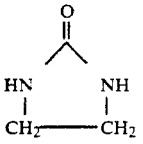
HBS-1 tricresyl phosphate
HBS-2 dibutyl phthalate
HBS-3 bis(2-ethylhexyl) phthalate
HBS-4
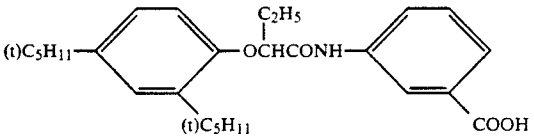
H-1
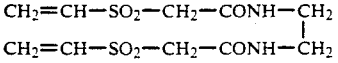
Sensitizing dye I -continued
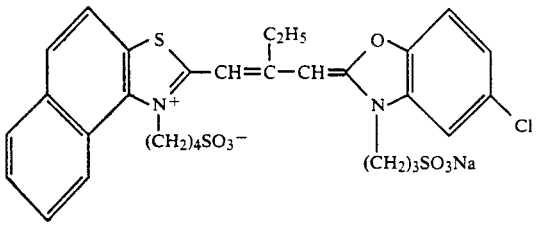
Sensitizing dye II
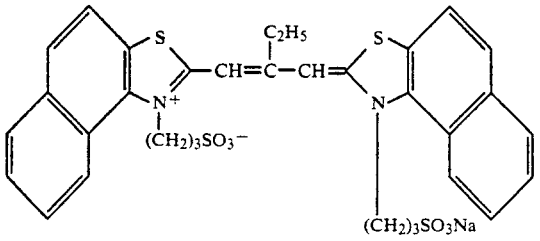
Sensitizing dye III
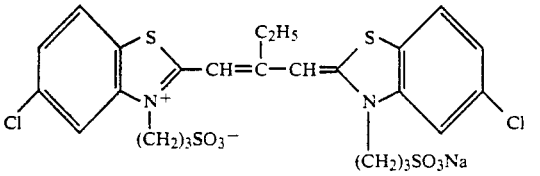
Sensitizing dye IV
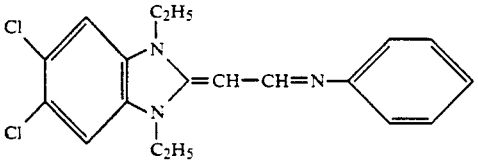
Sensitizing dye V
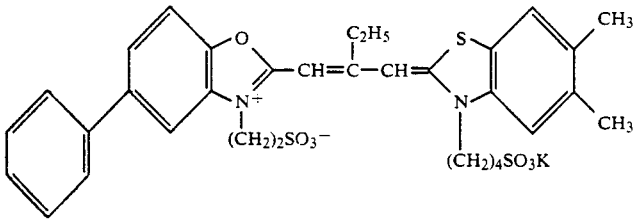
Sensitizing dye VI
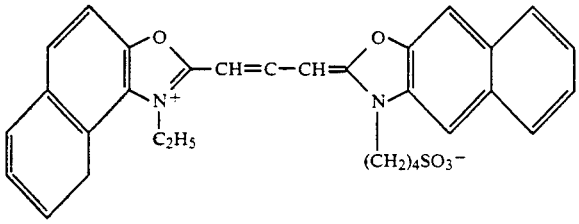
Sensitizing dye VII -continued

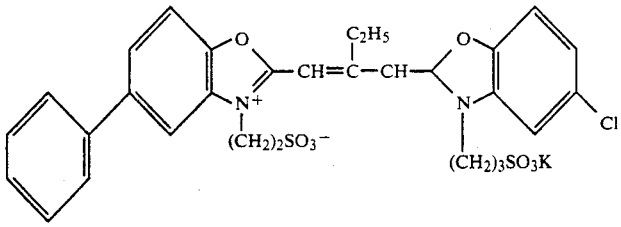

Sensitizing dye VIII

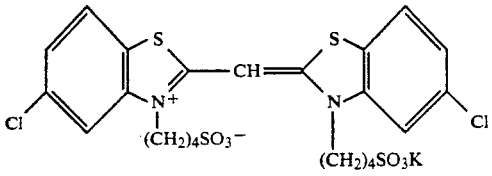

Sensitizing dye IX

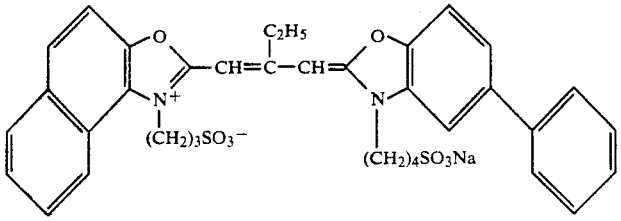

After exposure, the photosensitive material was processed in a conventional automatic processor (color negative film automatic processor model FP-350 for Mini Labo Champion 23 manufactured by Fuji Photo-Film Co., Ltd.) over a period of 6 months until the accumulative amount of color developer replenished reached 3 times the volume of the mother liquid tank.

| Processing steps | Time | Temp. | Replenisher amount* | Tank volume |
|---|---|---|---|---|
| Color development | 3'15" | 38° C. | 45 ml | 10 l |
| Bleach | 1'00" | 38° C. | 20 ml | 4 l |
| Blix | 3'15" | 38° C. | 30 ml | 8 l |
| Wash (1) | 40" | 35° C. | counter flow** | 4 l |
| Wash (2) | 1'00" | 35° C. | 30 ml | 4 l |
| Stabilizing | 40" | 38° C. | 20 ml | 4 l |
| Drying | 1'15" | 55° C. | | |

*Volume of solution replenished per meter of 35-mm film.
**Washing in a counterflow mode from tank (2) to (1).

Each processing solution had the following composition.

| Ingredients | | |
|---|---|---|
| Color Developer | Mother | Replenisher |
| Diethylene triamine pentaacetate | 1.0 g | 1.1 g |
| 1-hydroxyethylidene-1,1-diphosphonic acid | 3.0 g | 3.2 g |
| Sodium sulfite | 4.0 g | 4.4 g |
| Potassium carbonate | 30.0 g | 37.0 g |
| Potassium bromide | 1.4 g | 0.7 g |
| Potassium iodide | 1.5 mg | — |
| Hydroxylamine hydrogen sulfate | 2.4 g | 2.8 g |
| 4-(N-ethyl-N-β-hydroxyethylamino)-2-methylaniline hydrogen sulfate | 4.5 g | 5.5 g |
| Water totaling to | 1.0 l | 1.0 l |
| pH | 10.05 | 10.10 |

| Bleaching solution | Mother/Replenisher |
|---|---|
| Ammonium ferric ethylenediamine tetraacetate dihydrate | 120.0 g |

-continued

| Ingredients | |
|---|---|
| Disodium ethylenediamine tetraacetate | 10.0 g |
| Ammonium bromide | 100.0 g |
| Ammonium nitrate | 10.0 g |
| Bleaching promoter | 0.005 mol |

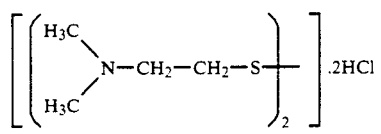

| | |
|---|---|
| Aqueous ammonia (27%) | 15.0 ml |
| Water totaling to | 1.0 l |
| pH | 6.3 |

| Blix solution | Mother | Replenisher |
|---|---|---|
| Ammonium ferric ethylenediamine tetraacetate dihydrate | 50.0 g | — |
| Disodium ethylenediamine tetraacetate | 5.0 g | — |
| Sodium sulfite | 12.0 g | 18.0 g |
| Aqueous ammonium thiosulfate (70%) | 240 ml | 360 ml |
| Aqueous ammonia (27%) | 6.0 ml | — |
| Water totaling to | 1.0 l | 1.0 l |
| pH | 7.2 | 7.9 |

Washing Liquid (Common to Mother and Replenisher)

City water was passed through a mixed bed column loaded with an H type strong acid cation-exchange resin (Amberlite IR-120B by Rohm & Haas Co.) and an OH type anion-exchange resin (Amberlite IR-400) to reduce the calcium and magnesium ion concentrations to 3 mg/l or lower. To the deionized water were added 20 mg/l of sodium isocyanurate dichloride and 0.15 g/l of sodium sulfate. This liquid was at pH 6.5 to 7.5.

| Stabilizing solution | |
|---|---|
| Ingredients | Mother/replenisher |
| Formalin (37%) | 2.0 ml |
| Polyoxyethylene-p-monononylphenyl ether (average polymerization degree 10) | 0.3 g |
| Disodium ethylenediamine tetraacetate | 0.05 g |
| Water totaling to | 1 liter |
| pH | 5.0–8.0 |

This procedure is designated Procedure A. The crossover time between the bleaching and bleach-fixing tanks was 15 seconds.

The bleach-fixing solution was replenished by admitting an overflow of the bleaching solution into the bleach-fixing tank and replenishing only a fixing solution (designated as the replenisher of the bleach-fixing solution) to the bleach-fixing tank, with the exhausted solution overflowing from the bleach-fixing tank.

Procedure A was repeated except that the bleaching and bleach-fixing steps were carried out as described below using the processing tank shown in FIGS. 1 and 2. This procedure is designated Procedure B.

The processing tank included five compartments each having a volume of 260 ml.

The flow of processing solution was about 0.1 ml/min. during quiescent periods and about 20 ml/min. during operation.

Prior to processing, the compartments were filled with the processing solution by first supplying the bleaching solution from the first compartment, and then supplying the fixing solution (designated as the replenisher of the bleach-fixing solution) from the third compartment until the solution overflowed from the fifth compartment.

The photosensitive material was processed while replenishing the bleaching and fixing solutions from the first and third compartments, respectively. The amounts of the bleaching and fixing solutions replenished were reduced by 20% from the replenishing amounts used in Procedure A. The processing time was 4 minutes 15 seconds.

Also in this procedure, the bleaching and fixing solutions were passed in a parallel flow direction.

The running operation was carried out for 6 months until the accumulative amount of developer replenished reached 3 times the tank volume.

Procedures A and B were compared for the quantity of the bleaching and (bleach-)fixing solutions replenished per meter of 35 mm wide film. The results are shown in Table 1.

For Procedure B, the ratio C3/C4 of the concentration of bleaching agent in the third compartment (C3) to the concentration of bleaching agent in the fourth compartment (C4) is also reported as a concentration gradient of bleaching agent.

TABLE 1

| | Procedure | |
|---|---|---|
| | A (comparison) | B (invention) |
| Tank number | 2 | 1 |
| Tank volume | | |
| Bleaching tank | 4 l | 260 ml × 5 |
| Bleach-fixing tank | 8 l | |
| Crossover time | 15 sec. | — |
| Replenishing quantity | | |
| Bleaching solution | 20 ml | 16 ml |
| (Bleach-)fixing solution | 30 ml | 24 ml |
| Total replenishment | 50 ml | 40 ml |
| Concentration gradient of bleaching agent, C3/C4 | — | 2.5 |

As shown in Table 1, Procedure B could reduce the quantity of solution replenished as compared with Procedure A without causing desilvering deficiency, while achieving photographic properties at a satisfactory level. In turn, Procedure A failed to provide satisfactory photographic properties due to deficient desilvering and formation of sulfides of fixing components. Also, Procedure B could save the crossover time for transfer between the bleaching and bleach-fixing tanks from the overall processing time and the total quantity of solution replenished.

Further, Procedures A and B were carried out in a scale-up manner to process an extremely large quantity of photosensitive material such that the accumulative amount of color developer replenished reached 30 liters in two days. Color recovery deficiency occurred with Procedure A, but not with Procedure B.

EXAMPLE 2

Procedure B of Example 1 was repeated except that the processing tank of FIG. 3 was used instead of the tank of FIGS. 1 and 2. This procedure is designated Procedure C.

The processing tank included 11 compartments each having a volume of 120 ml. The flow of processing solution was about 0.2 ml/min. during quiescent periods and about 15 ml/min. during operation.

The bleaching solution used herein was concentrated 20% as compared with that used in Procedure A. The fixing solution used herein was concentrated 20% as compared with the fixing solution designated as the replenisher of the bleach-fixing solution in Procedure A.

In accordance with Procedure B in Example 1, the bleaching and fixing solutions were supplied from the first and fourth compartments, respectively, prior to processing, and the bleaching and fixing solutions were replenished from the first and fourth compartments during operation, with the solution overflowing from the final compartment.

The processing time was about 4 minutes (about 22 seconds per compartment).

The bleaching and fixing solutions were passed in a parallel flow direction.

The running operation was carried out until the accumulative amount of developer replenished reached 3 times the tank volume.

For Procedure C, the quantity of the bleaching and (bleach-)fixing solutions replenished per meter of 35 mm wide film is reported in Table 2 in comparison with Procedure A of Example 1.

TABLE 2

| | Procedure | |
|---|---|---|
| | A (comparison) | C (invention) |
| Tank number | 2 | 1 |
| Tank volume | | |

TABLE 2-continued

| | Procedure | |
|---|---|---|
| | A (comparison) | C (invention) |
| Bleaching tank | 4 l | 120 ml × 11 |
| Bleach fixing tank | 8 l | |
| Crossover time | 15 sec. | — |
| Replenishing quantity | | |
| Bleaching solution | 20 ml | 12 ml |
| (Bleach-)fixing solution | 30 ml | 12 ml |
| Total replenishment | 50 ml | 24 ml |

As shown in Table 2, Procedure C could reduce the quantity of solution replenished as compared with Procedure A, while achieving photographic properties at a satisfactory level. Also, Procedure C could shorten the processing time and was advantageous in eliminating the crossover time and reducing the quantity of solution replenished.

Like Procedure B, Procedure C caused no problem even in processing an extremely large quantity as well as an extremely small quantity.

EXAMPLE 3

Procedure C of Example 2 was repeated except that the processing tank of FIG. 5 was used instead of the tank of FIG. 3. This procedure is designated Procedure D.

The processing tank included 20 compartments each having a volume of 150 ml. The flow of processing solution was about 3 ml/min. during quiescent periods and about 6 ml/min. during operation. The processing path had a gap of 6 mm in cross section and a length of 167 cm.

The bleaching and fixing solutions were supplied from the first and fifth compartments, respectively, and replenishment was started prior to processing of the photosensitive material.

The processing time was 3 minutes 45 seconds.

The results of Procedure D are reported in Table 3 in comparison with Procedure A of Example 1.

TABLE 3

| | Procedure | |
|---|---|---|
| | A (comparison) | D (invention) |
| Tank number | 2 | 1 |
| Tank volume | | |
| Bleaching tank | 4 l | 150 ml × 20 |
| Bleach-fixing tank | 8 l | |
| Crossover time | 15 sec. | — |
| Replenishing quantity | | |
| Bleaching solution | 20 ml | 12 ml |
| (Bleach-)fixing solution | 30 ml | 12 ml |
| Total replenishment | 50 ml | 24 ml |

As shown in Table 3, Procedure D could reduce the quantity of solution replenished as compared with Procedure A, while achieving photographic properties at a satisfactory level. Also, Procedure D could shorten the processing time and was advantageous in eliminating the crossover time and reducing the quantity of solution replenished.

Like Procedures B and C, Procedure D caused no problem even in processing an extremely large quantity as well as an extremely small quantity.

Further, the use of the belt conveyor system ensured that the photosensitive material traveled smoothly through the processing path of slit-shaped cross section.

EXAMPLE 4

A multi-layer color photosensitive material was prepared by coating a primed cellulose triacetate film support with the coating compositions of Example 1 in a multi-layer arrangement.

After exposure, the photosensitive material was processed in a conventional automatic processor (color negative film automatic processor model FP-350 for Mini Labo Champion 23 manufactured by Fuji Photo-Film Co., Ltd.) over a period of 6 months until the accumulative amount of color developer replenished reached 3 times the volume of the mother liquid tank.

| Processing steps | Time | Temp. | Replenisher amount* | Tank volume |
|---|---|---|---|---|
| Color development | 3'15" | 38° C. | 41 ml | 10 l |
| Bleach | 1'00" | 38° C. | 18 ml | 4 l |
| Blix | 3'15" | 38° C. | 27 ml | 8 l |
| Wash (1) | 40" | 35° C. | counter flow** | 4 l |
| Wash (2) | 1'00" | 35° C. | 27 ml | 4 l |
| Stabilizing | 40" | 38° C. | 18 ml | 4 l |
| Drying | 1'15" | 55° C. | | |

*Volume of solution replenished per meter of 135-size film.
**Washing in a counterflow mode from tank (2) to (1).

Procedure A was repeated in accordance with the above schedule. This procedure is designated Procedure A'.

As previously described, the bleach-fixing solution was replenished by admitting an overflow of the bleaching solution into the bleach-fixing tank and replenishing only a fixing solution (designated as the replenisher of the bleach-fixing solution) to the bleach-fixing tank, with the exhausted solution overflowing from the bleach-fixing tank.

Procedure A' was repeated except that the bleaching and bleach-fixing steps were carried out as described below using the processing tank shown in FIG. 5. This procedure is designated Procedure E.

The processing tank included five compartments each having a volume of 260 ml.

The flow of processing solution was about 0.1 ml/min. during quiescent periods and about 20 ml/min. during operation.

Prior to processing, the compartments were filled with the processing solution by first supplying the bleaching solution from the first compartment, and then supplying the fixing solution (designated as the replenisher of the bleach-fixing solution) from the fifth compartment until the solution overflowed from the fifth compartment.

The photosensitive material was processed while replenishing the bleaching and fixing solutions from the first and fifth compartments, respectively. The amounts of the bleaching and fixing solutions (as formulated in Example 1) replenished were reduced both by 20% from the replenishing amounts used in Procedures A and A'. The processing time was 4 minutes 15 seconds.

In this procedure, the bleaching solution was passed as a parallel flow while the fixing solution was passed as a counter flow.

The running operation was carried out for 6 months until the accumulative amount reached 3 times the tank volume.

Procedures A' and E were compared for the quantity of the bleaching and (bleach-)fixing solutions replenished per meter of 135-size film. The results are shown in Table 4.

TABLE 4

| | Procedure | |
|---|---|---|
| | A' (comparison) | E (invention) |
| Tank number | 2 | 1 |
| Tank volume | | |
| Bleaching tank | 4 l | 260 ml × 5 |
| Bleach-fixing tank | 8 l | |
| Crossover time | 15 sec. | — |
| Replenishing quantity | | |
| Bleaching solution | 18 ml | 15 ml |
| (Bleach-)fixing solution | 27 ml | 20 ml |
| Total replenishment | 45 ml | 35 ml |

As shown in Table 4, Procedure E could reduce the quantity of solution replenished as compared with Procedure A' without causing deficient desilvering, while achieving photographic properties at a satisfactory level. In turn, Procedure A' failed to provide satisfactory photographic properties due to deficient desilvering and formation of sulfides of fixing components.

Also, Procedure E could save the crossover time for transfer between the bleaching and bleach-fixing tanks from the overall processing time and the total quantity of solution replenished.

Further, Procedures A' and E were carried out in a scale-up manner to process an extremely large quantity of photosensitive material such that the accumulative amount of color developer replenished reached 30 liters in two days. Color recovery deficiency occurred with Procedure A', but not with Procedure E by virtue of the reduced content of bleaching agent.

Procedure E carried out processing with substantially only the fixing solution at the later stage of the desilvering process, resulting in a substantial reduction of the load of water washing in the subsequent step.

In fact, Procedure E reduced the quantity of wash water replenished by about 25% as compared with Procedure A'.

EXAMPLE 5

Procedure E of Example 4 was repeated except the use of the processing tank of FIG. 11 and the following changes. This procedure is designated Procedure F.

The processing tank included 11 compartments each having a volume of 180 ml.

Prior to processing, the compartments were filled with the processing solution by supplying the bleaching solution from the first compartment, supplying the fixing solution (designated as the replenisher of the bleach-fixing solution in Example 1) from the sixth compartment, and supplying the wash water from the eleventh compartment until the solution overflowed from the third compartment.

The photosensitive material was processed while replenishing the bleaching solution from the first compartment, the fixing solution from the sixth compartment, and the wash water from the eleventh compartment.

Procedures A' and F were compared for the quantity of the bleaching and (bleach-)fixing solutions replenished per meter of 135-size film. The results are shown in Table 5.

TABLE 5

| | Procedure | |
|---|---|---|
| | A' (comparison) | F (invention) |
| Tank number | 4 | 1 |
| Tank volume | | |
| Bleaching tank | 4 l | 180 ml × 11 |
| Bleach-fixing tank | 8 l | |
| Crossover time | 15 × 3 sec. | — |
| Replenishing quantity | | |
| Bleaching solution | 18 ml | 13 ml |
| (Bleach-)fixing solution | 27 ml | 17 ml |
| Wash liquid | 27 ml | 17 ml |
| Total replenishment | 72 ml | 47 ml |

As shown in Table 5, Procedure F could reduce the quantity of solution replenished by 35% as compared with Procedure A' without causing deficient desilvering and stains, while achieving photographic properties at a satisfactory level. Also, Procedure F could save the crossover time, finishing the process quicker.

The quantity of solution discharged was also reduced.

EXAMPLE 6

Procedure E of Example 4 was repeated except the processing tank of FIG. 12 was used, and the photosensitive material was processed by supplying the bleaching solution, fixing solution (designated as the replenisher of the bleach-fixing solution in Example 1), and wash liquid from the compartments assigned in the FIGURE while allowing the solution to overflow through the overflow conduit connected to the path at the indicated location. This procedure is designated Procedure G.

Procedures A' and G were compared for the processing time required for desilvering and washing steps and the quantity of the desilvering solutions and wash liquid replenished per meter of 135-size film.

The results are shown in Table 6.

TABLE 6

| | Procedure | |
|---|---|---|
| | A' (comparison) | G (invention) |
| Processing time | | |
| Bleaching | 60 sec. | 40 sec. |
| Bleach-fixing | 195 sec. | 80 sec. |
| Fixing | — | 80 sec. |
| Washing | 100 sec. | 120 sec. |
| Total | 355 sec. | 320 sec. |
| Replenishing quantity | | |
| Bleaching solution | 18 ml | 15 ml |
| Bleach-fixing solution | 27 ml | 5 ml |
| Fixing solution | — | 15 ml |
| Wash liquid | 27 ml | 20 ml |
| Total | 72 ml | 55 ml |

As shown in Table 6, Procedure G could shorten the processing time and reduce the quantity of solution replenished as compared with Procedure A'. Procedure G achieved satisfactory photographic properties without causing deficient desilvering and stains.

BENEFITS OF THE INVENTION

The present invention can reduce the quantity of processing solution having a desilvering function used, especially replenished.

Fault like deficient desilvering does not occur and images with satisfactory photographic properties are obtained.

Particularly when bleaching and fixing solutions are delivered from the entrance and exit side of the tank for photosensitive material, the step immediately before the washing step becomes a step of processing substantially with the fixing solution in which the amount of bleaching agent is minimized, alleviating the washing load.

The processing apparatus to which the method of the invention is applied can be made compact.

Further, water washing and/or stabilization as the subsequent step to the desilvering process can be successively carried out, leading to a further compact processing apparatus and a shorter processing time. With such continuous processing, stains and other defects do not occur and the quantity of solution discharged is reduced.

We claim:

1. In a method for wet processing a silver halide photosensitive material after development by desilvering the photosensitive material with a processing solution having a desilvering function in a processing tank, the improvement comprising the steps of:

providing a plurality of compartments partitioned in the processing tank and serially connecting the compartments to define a continuous processing path having an entrance and an exit for the photosensitive material, filling the processing path with the processing solution such that the processing solution in at least one compartment has a different composition from the processing solution in at least one of the remaining compartments, and successively passing the photosensitive material through the compartments of the processing path without contact with the ambient air.

2. The method of claim 1 wherein said at least one compartment is filled with a processing solution selected from the group consisting of a processing solution having a substantial bleaching function, a processing solution having a substantial fixing function, and a processing solution having substantial bleaching and fixing functions, and said at least one of the remaining compartments is filled with a processing solution selected from said group, but different from the selected solution in said at least one compartment.

3. The method of claim 2 wherein said continuous processing path includes at least two regions filled with different processing solutions selected from said group.

4. The method of claim 1 wherein said continuous processing path includes a plurality of inlets for respectively replenishing a corresponding plurality of processing solutions having different compositions at different locations.

5. The method of claim 2 or 3 wherein said continuous processing path includes a plurality of inlets for respectively replenishing a corresponding plurality of processing solutions having different functions at different locations, the processing solutions being selected from the group consisting of a processing solution having a substantial bleaching function, a processing solution having a substantial fixing function, and a processing solution having substantial bleaching and fixing functions.

6. The method of claim 4 wherein said continuous processing path includes a first region filled with a processing solution having a substantial bleaching function and a second region disposed on the exit side of the first region for the photosensitive material and filled with a processing solution having substantial bleaching and fixing functions.

7. The method of claim 6 which includes the steps of:

providing a first inlet on the entrance side of said first region for the photosensitive material, replenishing the processing solution having a substantial bleaching function into said first region through the first inlet, providing a second inlet on the entrance side of said second region for the photosensitive material, and replenishing the processing solution having a substantial fixing function into said second region through the second inlet.

8. The method of claim 7 wherein an outlet is disposed on the exit side of said second region for the photosensitive material for discharging the solution.

9. The method of claim 4 wherein said continuous processing path includes a first region filled with a processing solution having a substantial bleaching function, a second region disposed on the exit side of the first region for the photosensitive material and filled with a processing solution having substantial bleaching and fixing functions, and a third region disposed on the exit side of the second region for the photosensitive material and filled with a processing solution having a substantial fixing function.

10. The method of claim 9 which includes the steps of:

providing a first inlet on the entrance side of said first region for the photosensitive material, replenishing the processing solution having a substantial bleaching function into said first region through the first inlet, providing a second inlet on the exit side of said third region for the photosensitive material, and replenishing the processing solution having a substantial fixing function into said third region through the second inlet.

11. The method of claim 10 which includes the steps of:

providing a third inlet on the entrance side of said second region for the photosensitive material, and replenishing the processing solution having a substantial fixing function into said second region through the third inlet.

12. The method of claim 11 wherein an outlet is disposed in said second region for discharging the solution.

13. The method of claim 1 wherein said continuous processing path includes a channel for providing flow communication between the compartments.

14. The method of claim 1 wherein at least three processing compartments are partitioned in the tank.

15. The method of claim 1 wherein the tank further includes partitions for partitioning the compartments such that little flow of processing solution occurs between the compartments when no photosensitive material is passed.

16. The method of any one of claims 6 to 8 wherein said continuous processing path further includes a region disposed on the exit side of said second region for the photosensitive material and filled with a processing solution having a washing and/or stabilizing function.

17. The method of any one of claims 9 to 11 wherein said continuous processing path further includes a region disposed on the exit side of said third region for the photosensitive material and filled with a processing solution having a washing and/or stabilizing function.

* * * * *